US012703558B2

(12) United States Patent
Nguyen et al.

(10) Patent No.: US 12,703,558 B2
(45) Date of Patent: Aug. 11, 2026

(54) DISPENSING SYSTEMS

(71) Applicant: S. C. Johnson & Son, Inc., Racine, WI (US)

(72) Inventors: Peter N. Nguyen, Racine, WI (US); Therese A. Rozek, Union Grove, WI (US); Joseph G. Stichart, Oak Creek, WI (US); Jason L. Halonen, Waterford, WI (US); Margaret Fowler, Elgin, IL (US); Ngoc H. Pham, Kenosha, WI (US); Brian T. Davis, Burlington, WI (US); Jake Schwer, Muskego, WI (US); Kylie L. Levake, Union Grove, WI (US)

(73) Assignee: S. C. JOHNSON & SON, INC., Racine, WI (US)

( * ) Notice: Subject to any disclaimer, the term of this patent is extended or adjusted under 35 U.S.C. 154(b) by 706 days.

(21) Appl. No.: 17/845,359

(22) Filed: Jun. 21, 2022

(65) Prior Publication Data

US 2022/0402685 A1 Dec. 22, 2022

Related U.S. Application Data

(60) Provisional application No. 63/213,528, filed on Jun. 22, 2021.

(51) Int. Cl.
*B65D 83/20* (2025.01)
*B65D 83/141* (2025.01)
*B65D 83/30* (2025.01)

(52) U.S. Cl.
CPC ..... *B65D 83/20* (2013.01); *B65D 83/141* (2025.01); *B65D 83/30* (2013.01)

(58) Field of Classification Search
USPC ..... 239/1
See application file for complete search history.

(56) References Cited

U.S. PATENT DOCUMENTS 3,112,074 A 11/1963 Green
3,129,893 A 4/1964 Green
(Continued)

FOREIGN PATENT DOCUMENTS

EP 0372011 B1 6/1995
EP 1610045 B1 7/2007
(Continued)

OTHER PUBLICATIONS

RU-2700697-C1 Sep. 19, 2019 Bevinakatti.*
(Continued)

*Primary Examiner* — Christopher S Kim
(74) *Attorney, Agent, or Firm* — Quarles & Brady LLP

(57) ABSTRACT

A dispensing system includes a composition that includes one or more of a deodorizing composition, a fragrancing composition, or a cleaning composition. The system includes a container having a body. The composition is disposed within the container, and a pressure within the container is at least 930 kPa. The system further includes an actuator assembly coupled with the container. The actuator assembly includes a housing, an actuator positioned within the housing and comprising a fluid passageway in fluid communication with the composition, and a nozzle insert disposed within the fluid passageway. The nozzle insert defines a nozzle orifice having an orifice diameter of between about 0.335 mm and about 0.385 mm, and the composition comprises a compressed gas and between about 5% and about 10% by volume ethanol.

16 Claims, 26 Drawing Sheets

(56) References Cited

U.S. PATENT DOCUMENTS 3,226,040 A 12/1965 Briechle et al.
3,406,911 A 10/1968 Keeny
3,416,737 A 12/1968 Venus
3,437,270 A 4/1969 Venus
3,785,571 A 1/1974 Hoening
3,881,658 A 5/1975 Greenebaum, II et al.
3,994,442 A 11/1976 Hoening
4,056,213 A 11/1977 Stern
4,071,196 A 1/1978 Burke et al.
4,322,037 A 3/1982 Heeb et al.
4,367,847 A 1/1983 Bayer
4,706,888 A 11/1987 Dobbs
4,779,803 A 10/1988 Corsette
4,979,678 A 12/1990 Ruscitti et al.
4,991,778 A 2/1991 Maas et al.
5,110,052 A 5/1992 Graf et al.
5,337,926 A 8/1994 Drobish et al.
5,411,185 A 5/1995 Drobish
5,540,389 A 7/1996 Knickerbocker
5,547,132 A 8/1996 Grogan
5,641,125 A 6/1997 Martin et al.
5,676,311 A 10/1997 Hartman
5,711,488 A 1/1998 Lund
5,738,282 A 4/1998 Grogan
5,769,325 A 6/1998 Jouillat et al.
5,931,386 A 8/1999 Jouillat
5,934,569 A 8/1999 Soule et al.
5,992,765 A 11/1999 Smith
6,000,633 A 12/1999 Lund et al.
6,142,390 A 11/2000 Nordstrom et al.
6,186,371 B1 2/2001 de Pous et al.
6,199,766 B1 3/2001 Fox et al.
6,241,165 B1 6/2001 Bickart et al.
6,279,834 B1 8/2001 Fox et al.
6,341,735 B1 1/2002 Baudin
6,398,082 B2 6/2002 Clark et al.
6,418,925 B1 7/2002 Genova et al.
6,443,370 B1 9/2002 Brulle et al.
6,482,357 B1 11/2002 Fox et al.
RE38,022 E 3/2003 de Laforcade
6,533,196 B1 3/2003 Ouin et al.
6,543,703 B2 4/2003 Blake
6,585,172 B2 7/2003 Arghyris
6,609,666 B1 8/2003 Blake
6,722,585 B1 4/2004 Stradella
6,817,493 B1 11/2004 Parsons et al.
6,820,823 B2 11/2004 Parsons et al.
6,908,017 B2 6/2005 Mineau et al.
6,959,879 B2 11/2005 Laidler et al.
6,971,560 B1 12/2005 Healy et al.
6,997,397 B1 2/2006 Keung et al.
7,004,359 B2 2/2006 Marroncles
7,036,691 B2 5/2006 Nicolas
7,143,959 B2 12/2006 Smith et al.
7,204,393 B2 4/2007 Strand
7,300,001 B2 11/2007 Kuo
7,370,815 B2 5/2008 Fecht et al.
7,370,817 B2 5/2008 Tilton et al.
7,478,767 B2 1/2009 Wu
7,487,891 B2 2/2009 Yerby et al.
7,530,476 B2 5/2009 Downey et al.
7,575,132 B2 8/2009 Stuart et al.
7,621,468 B2 11/2009 Smith et al.
7,694,895 B2 4/2010 Bougamont et al.
7,748,648 B2 7/2010 Songbe et al.
7,757,905 B2 7/2010 Strand et al.
7,784,650 B2 8/2010 Bates et al.
RE41,864 E 10/2010 Soule et al.
7,828,231 B2 11/2010 Harms
7,886,995 B2 2/2011 Togashi
7,922,041 B2 4/2011 Gurrisi et al.
7,938,342 B2 5/2011 Octeau et al.
7,980,491 B2 7/2011 Kakade et al.
8,100,298 B2 1/2012 Marquardt et al.
8,127,968 B2 3/2012 Yerby et al.
8,191,801 B2 6/2012 Khan et al.
8,191,802 B2 6/2012 Khan et al.
8,196,847 B2 6/2012 Helie et al.
8,276,832 B2 10/2012 Nelson et al.
8,276,835 B2 10/2012 Lowry et al.
8,313,045 B2 11/2012 Levitsky
8,322,630 B2 12/2012 Richardson et al.
8,322,631 B2 12/2012 Richardson et al.
8,323,020 B2 12/2012 Helie et al.
8,333,332 B2 12/2012 Burghaus et al.
8,337,778 B2 12/2012 Stone et al.
8,413,912 B2 4/2013 Songbe
8,418,892 B2 4/2013 Geier
8,418,940 B2 4/2013 Songbe et al.
8,496,137 B2 7/2013 Alfaro et al.
8,616,468 B2 12/2013 Hull et al.
8,622,256 B2 1/2014 Campbell
8,690,081 B2 4/2014 Cornet et al.
8,769,818 B2 7/2014 Helie et al.
8,807,457 B2 8/2014 Songbe
8,820,665 B2 9/2014 Nelson et al.
8,844,843 B2 9/2014 Horiuchi et al.
8,870,030 B2 10/2014 Demarest et al.
8,881,944 B2 11/2014 Paas et al.
8,960,504 B2 2/2015 Benson et al.
8,967,436 B2 3/2015 Andersen et al.
8,978,937 B2 3/2015 Chambers et al.
8,985,398 B2 3/2015 Demarest et al.
8,998,111 B2 4/2015 Sun
9,027,854 B2 5/2015 Moser et al.
9,061,816 B2 6/2015 Best et al.
9,089,856 B2 7/2015 Gopalan et al.
9,101,946 B2 8/2015 Hull et al.
9,174,229 B2 11/2015 Smith
9,205,618 B2 12/2015 Campbell et al.
9,205,973 B2 12/2015 Decea et al.
9,242,256 B2 1/2016 Clark et al.
9,260,237 B1 2/2016 Brace et al.
9,284,112 B2 3/2016 Ghavami-Nasr et al.
9,296,549 B2 3/2016 Ghavami-Nasr et al.
9,375,739 B2 6/2016 Ivri
9,393,336 B2 7/2016 Ghavami-Nasr et al.
9,409,194 B2 8/2016 Alluigi
9,505,546 B2 11/2016 Arora et al.
9,511,381 B2 12/2016 Takahashi
9,511,926 B2 12/2016 Arora et al.
9,517,478 B2 12/2016 Hull et al.
9,527,092 B2 12/2016 Miyamoto et al.
9,555,953 B2 1/2017 Baudin
9,714,131 B2 7/2017 Arora et al.
9,802,750 B2 10/2017 Demarest et al.
9,802,751 B2 10/2017 Demarest et al.
9,821,324 B2 11/2017 Hartranft et al.
9,862,535 B2 * 1/2018 Christianson ..... B65D 1/0223
9,938,070 B2 4/2018 Ogata et al.
9,981,799 B2 * 5/2018 Andersen ..... B65D 83/205
9,999,895 B2 6/2018 Nelson et al.
10,000,330 B2 6/2018 Szekely et al.
10,112,767 B2 10/2018 Neuhalfen et al.
10,130,960 B2 11/2018 Gopalan et al.
10,144,017 B2 12/2018 Davis et al.
10,154,870 B2 12/2018 Ottanelli
10,259,643 B2 * 4/2019 Christianson ..... B65D 83/262
10,293,356 B2 5/2019 Lee
10,364,091 B2 7/2019 Bodet et al.
10,427,862 B2 10/2019 Clark et al.
10,577,169 B2 3/2020 Bodet et al.
10,647,501 B2 5/2020 Richard et al.
10,661,973 B1 * 5/2020 Caruso ..... B65D 83/205
10,752,428 B2 8/2020 Das et al.
10,850,914 B2 12/2020 Bartolucci et al.
10,858,170 B2 12/2020 Eng et al.
10,940,493 B2 * 3/2021 Levake ..... B05B 15/14
11,034,507 B2 * 6/2021 Spang, Jr. ..... B65D 83/206
2005/0023368 A1 2/2005 Valpey et al.
2008/0067262 A1 3/2008 Varanasi et al.
2008/0093392 A1 4/2008 Abduljalil
2009/0020621 A1 1/2009 Clark
2009/0078785 A1 3/2009 Herminghaus

(56) References Cited

U.S. PATENT DOCUMENTS

| | | | | |
|---|---|---|---|---|
| 2009/0218418 | A1 | 9/2009 | Sharief | |
| 2010/0116909 | A1 | 5/2010 | Abduljalil | |
| 2011/0303767 | A1 | 12/2011 | Smith | |
| 2012/0037668 | A1 | 2/2012 | Bicknell et al. | |
| 2012/0205466 | A1 | 8/2012 | Baltz et al. | |
| 2014/0034745 | A1 | 2/2014 | Brace et al. | |
| 2014/0048617 | A1* | 2/2014 | Furner | A01M 1/2038 239/55 |
| 2016/0100667 | A1* | 4/2016 | Aubert | A61K 8/4973 222/394 |
| 2016/0158775 | A1 | 6/2016 | Petkus et al. | |
| 2016/0303270 | A1 | 10/2016 | Shah et al. | |
| 2018/0243763 | A1 | 8/2018 | Eurippini | |
| 2018/0244461 | A1 | 8/2018 | Kalagher et al. | |
| 2018/0319572 | A1* | 11/2018 | Vanderstraeten | B29C 66/71 |
| 2019/0177074 | A1* | 6/2019 | Waugh | B65D 83/18 |
| 2021/0155397 | A1* | 5/2021 | Stenghel | B65D 83/22 |
| 2021/0155398 | A1* | 5/2021 | Hosmer | B65D 83/48 |

FOREIGN PATENT DOCUMENTS

| | | | | |
|---|---|---|---|---|
| EP | 2163204 | B1 | 3/2016 | |
| EP | 2415690 | B1 | 3/2016 | |
| EP | 2207624 | B1 | 6/2017 | |
| EP | 3122469 | B1 | 12/2018 | |
| EP | 2969159 | B1 | 10/2019 | |
| EP | 2992967 | B1 | 5/2020 | |
| EP | 2496361 | B2 | 7/2020 | |
| FR | 2692904 | A1 * | 12/1993 | C09K 3/30 |
| GB | 2248888 | B | 7/1994 | |
| RU | 2700697 | C1 * | 9/2019 | A61K 8/73 |
| WO | 2005018812 | A2 | 7/2004 | |
| WO | 2005018820 | A1 | 3/2005 | |
| WO | 2009045426 | A1 | 4/2009 | |
| WO | 2014138207 | A1 | 9/2014 | |
| WO | 2014144393 | A1 | 9/2014 | |
| WO | 2011157932 | A1 | 6/2016 | |
| WO | 2017139272 | A1 | 8/2017 | |
| WO | 2017187134 | A1 | 11/2017 | |
| WO | 2019018893 | A1 | 1/2019 | |
| WO | 2020011799 | A1 | 1/2020 | |
| WO | 2020046934 | A1 | 3/2020 | |
| WO | 2020068696 | A1 | 4/2020 | |
| WO | 2020227308 | A1 | 11/2020 | |
| WO | 2021076725 | A1 | 4/2021 | |

OTHER PUBLICATIONS

FR-2692904-A1 Dec. 31, 1993 Alain.*

International Search Report and Written Opinion for PCT/US2022/034469, mailed Oct. 25, 2022 (13 pages).

* cited by examiner

DISPENSING SYSTEMS

CROSS REFERENCE TO RELATED APPLICATIONS

This application claims the benefit of and priority to U.S. Application No. 63/213,528, filed on Jun. 22, 2021, and entitled "DISPENSING SYSTEMS," which is incorporated by reference herein in its entirety.

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Disclosure

The present disclosure relates generally to dispensing systems including an actuator assembly for placement on a container, and in particular, dispensing systems that utilize compressed gas, modified formulations and pressures within the container, and improved nozzle inserts to achieve a more desirable spray pattern that reduces fallout.

2. Description of the Background of the Disclosure

Aerosol containers are commonly used to store and dispense products such as air freshening agents, deodorants, insecticides, germicides, decongestants, perfumes, or any other known products. The product is forced from the container through an aerosol valve by a hydrocarbon or non-hydrocarbon propellant. Typical aerosol containers comprise a body with an opening at a top end thereof. A mounting cup is crimped to the opening of the container to seal the top end of the body. The mounting cup is generally circular in geometry and may include an outer wall that extends upwardly from a base of the mounting cup adjacent the area of crimping. A pedestal also extends upwardly from a central portion of the base. A valve assembly includes a valve stem, a valve body, and a valve spring. The valve stem extends through the pedestal, wherein a distal end extends upwardly, away from the pedestal and a proximal end is disposed within the valve body. The valve body is secured within an inner side of the mounting cup and a dip tube may be attached to the valve body. The dip tube extends downwardly into an interior of the body of the container. The distal end of the valve stem is axially depressed along a longitudinal axis thereof to open the valve assembly. In other containers, the valve stem is tilted or displaced in a direction transverse to the longitudinal axis to radially actuate the valve stem. When the valve assembly is opened, a pressure differential between the container interior and the atmosphere forces the contents of the container out through an orifice of the valve stem.

Aerosol containers frequently include an actuator assembly that covers a top end of the container. Typical overcap or actuator assemblies are releasably attached to the container by way of an outwardly protruding ridge, which circumscribes the interior lower edge of the actuator assembly and interacts with a crimped seam that circumscribes a top portion of the container. When the assembly is placed onto the top portion of the container, downward pressure is applied to the assembly, which causes the ridge to ride over an outer edge of the seam and lock under a ledge defined by a lower surface of the seam. In some systems, the actuator assembly includes a dispensing orifice to allow product to escape therethrough. In such systems, an actuator typically interacts with the valve stem to release product into the actuator and out through the dispensing orifice of the actuator assembly. Further, such actuators typically include an actuation mechanism, such as a button or trigger, which is integral with the actuator. In some cases, nozzle assemblies for containers, e.g., as included on a larger actuator assembly, can include nozzle inserts and corresponding nozzle-insert cavities. During manufacturing (or at other times), a particular nozzle insert can be inserted into a nozzle-insert cavity to form a combined nozzle assembly that can provide a desired flow characteristic (e.g., spray pattern, flow rate, metering effect, and so on).

All of the foregoing characteristics of dispensing systems impact spray characteristics. In the specific context of fragrance dispensing systems, fallout is a spray characteristic that results from the aerosol spray, which can be a nuisance by creating residue along various surfaces within a spray zone. The unwanted residue that results from increased fallout is generally an undesirable effect and can cause a wetness that is unwanted by consumers. Further, many prior art dispensing systems dispense inconsistent sprays over the life of the products and fail to provide sufficient fragrance coverage within an enclosed room. The present disclosure relates generally to dispensing systems and, more specifically, to a product dispensing system having an actuator with a nozzle insert that addresses one or more aspects of prior art dispensing systems.

SUMMARY OF THE DISCLOSURE

According to some aspects of the disclosure, a dispensing system contains a composition consisting of one or more of a deodorizing composition, a fragrancing composition, or a cleaning composition. Further, the dispensing system includes a container having a cylindrical body and that defines a pressure therein. The composition is disposed within the container and the pressure is at least 930 kPa. An actuator assembly is attached to the container, the actuator assembly including a housing, an actuator positioned within the housing that has a fluid passageway in fluid communication with the composition, and a nozzle insert disposed within the fluid passageway. The nozzle insert defines a nozzle orifice having an orifice diameter of between about 0.335 mm and about 0.385 mm, and the composition comprises a compressed gas and between about 5% and about 10% by volume ethanol.

In some embodiments, a dispensing system contains a composition consisting of one or more of a deodorizing composition, a fragrancing composition, or a cleaning composition. The dispensing system includes a container having a valve stem defining a longitudinal axis and a body defining a pressure therein. The composition is disposed within the container, and the pressure is at least 930 kPa. An actuator assembly is attached to the container. The actuator assembly includes a housing, an actuator positioned within the housing and comprising a fluid passageway in fluid communication with the composition, and a nozzle insert disposed within the fluid passageway, the nozzle insert defining a spray axis that is between about 60° and about 70° offset from the longitudinal axis. The composition comprises a compressed gas and between about 5% and about 10% by volume ethanol.

In some embodiments, a method of dispensing a composition consisting of one or more of a deodorizing composition, a fragrancing composition, or a cleaning composition, comprises the step of providing a container having a body and defining a pressure therein, the composition being disposed within the container, and the pressure being at least 930 kPa. The method further includes the step of attaching an actuator assembly to the container, the actuator assembly including a housing, an actuator positioned within the housing and comprising a fluid passageway in fluid communication with the composition, and a nozzle insert disposed within the fluid passageway. The method also includes the step of spraying a composition having a fallout of between 25% and 30% from a spray height of between four feet and five feet.

DETAILED DESCRIPTION OF THE DRAWINGS

The present disclosure provides for dispensing systems comprising compressed gas aerosols with improved spray performance for use as an air freshener and/or odor eliminator. The dispensing systems disclosed herein achieve spray characteristics that provide for enhanced consumer experience by reducing fallout from spraying an aerosol. Fallout can be characterized as a wetness of the spray plume in the air and/or a build-up of residue on surfaces after use of a dispensing system. The present disclosure identifies key spray characteristics and formulation parameters which have been found to decrease and/or improve fallout from a compressed gas dispensing system. The spray characteristics include particle size, discharge rate, angle of spray, throw distance, spray cone diameter, percent fallout, fallout pattern, and particle velocity. The formulation parameters include percent makeup of volatile organic compounds ("VOCs"), the use of solvents, fill pressure, and percent headspace.

The spray performance of compressed gas aerosols is influenced by the formulation and the components used to contain the formulation. More specifically, performance can be significantly impacted by the spray insert or mechanical breakup unit ("MBU") that is used to aerosolize the formula. The function of the MBU is to break up the liquid formula to create particles for delivery out for its intended use. The formulation and components are designed to produce the desired spray characteristics. While the methods and systems disclosed herein may be embodied in many different forms, several specific embodiments are discussed herein with the understanding that the embodiments described in the present disclosure are to be considered only exemplifications of the principles described herein, and the disclosure is not intended to be limited to the embodiments illustrated. Throughout the disclosure, the terms "about" and "approximately" mean plus or minus 5% of the number or value that each term precedes.

Figure 1:
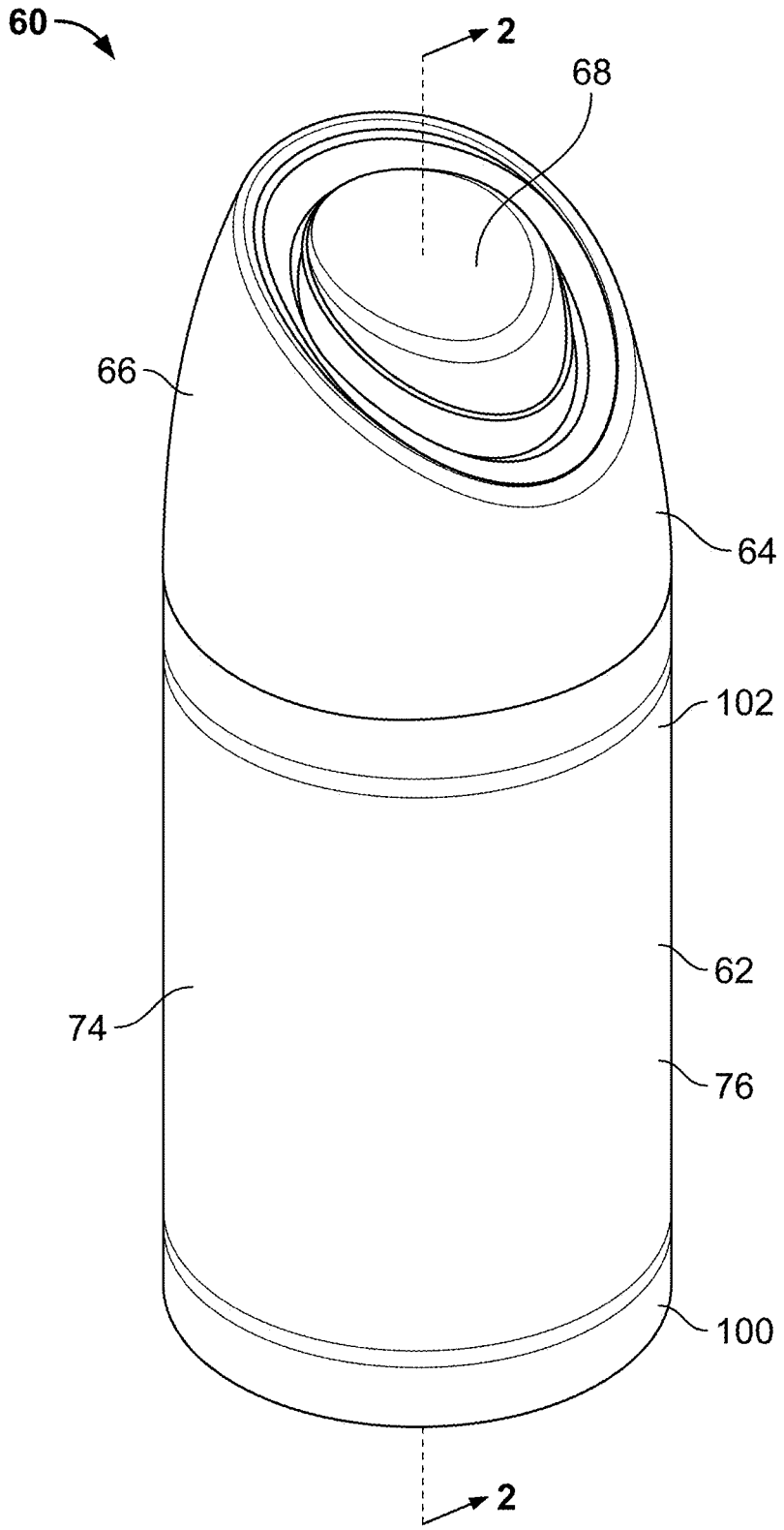
FIG. 1 is a rear isometric view of a product dispensing system that includes a container and an actuator assembly attached thereto.

Referring now to FIG. 1, a product dispensing system 60 is illustrated, which is configured to store and/or dispense an aerosol product (not shown). The dispensing system 60 includes a container 62 and an actuator assembly 64, which includes a housing 66, an actuator 68, and a nozzle insert 70 (see FIG. 2). In use, the actuator assembly 64 is configured to release the product from the container 62 upon the occurrence of a particular condition. For example, a user of the product dispensing system 60 may manually depress or otherwise activate the actuator 68 of the actuator assembly 64 to release the aerosol from the container 62. Throughout the disclosure, the actuator assembly 64 is depicted in various configurations.

The composition may be an aqueous formulation that is intended for emission as a pressurized product. The composition preferably is pressurized using one or more compressed gases, such as carbon dioxide, helium, hydrogen, neon, oxygen, xenon, nitrous oxide, or nitrogen, and further includes one or more polar solvents, such as alcohols, ketones, carboxylic acids, or amides. In a preferred embodiment, the polar solvent is an alcohol, and more specifically, ethanol. While the product dispensing system 60 is broadly adapted to dispense any number of aqueous formulations, the present dispensing system 60 has been particularly configured, as disclosed herein, to dispense one or more of a deodorizing composition, fragrancing composition, and cleaning composition. In a preferred embodiment, the composition includes an organic compound with a hydroxyl group, and is pressurized using one or more of the compressed gases listed above.

Figure 2:
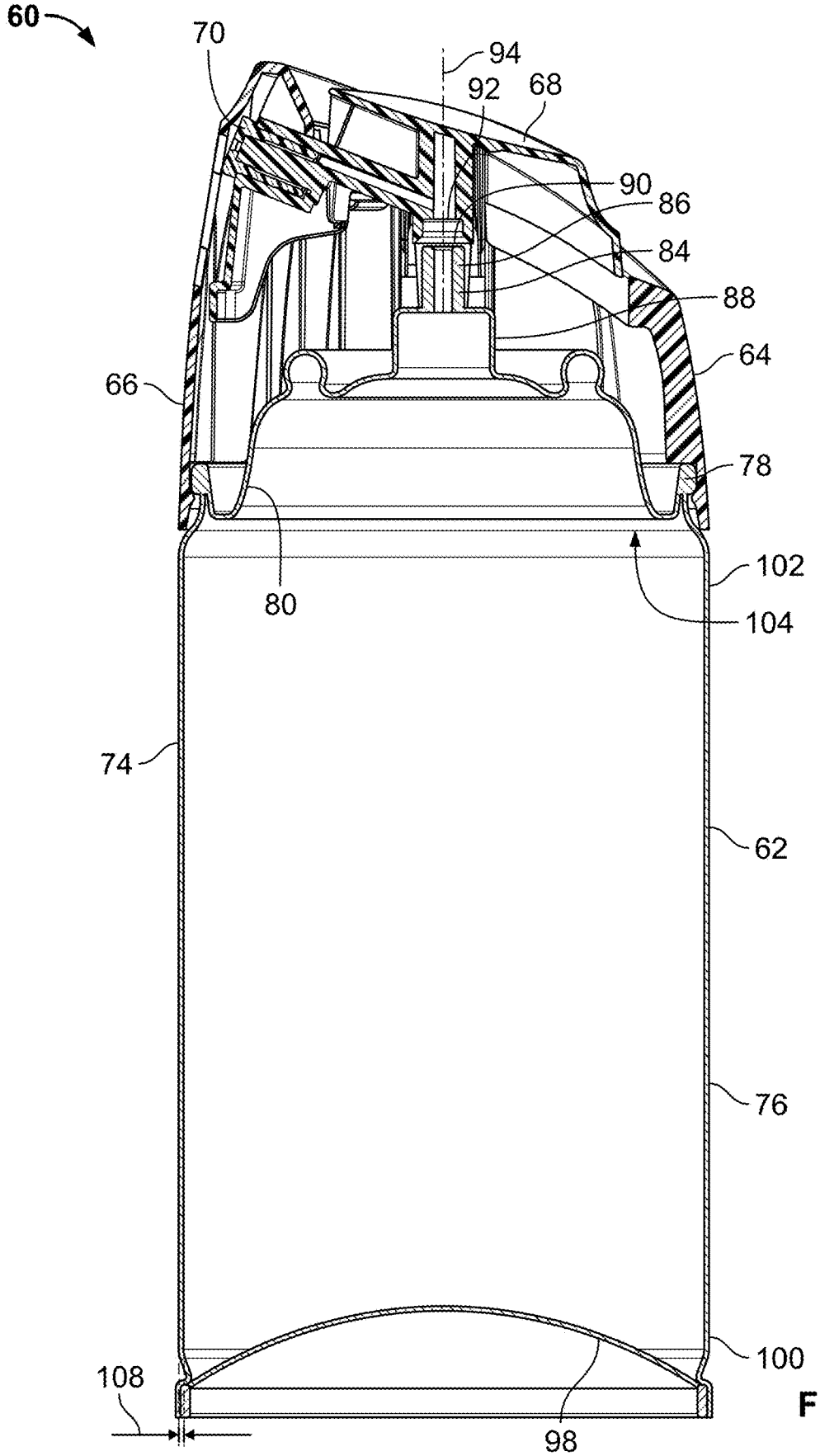
FIG. 2 is a cross-sectional view of the product dispensing system taken through line 2-2 of FIG. 1.

Referring to FIG. 2, the container 62 comprises a substantially cylindrical body 74 defining an outer sidewall 76. Further, a seam 78 and/or mounting cup 80 provide a location in which the actuator assembly 64 may be attached, as is known in the art. A conventional valve assembly 84 is shown, which includes a valve stem 86, which is connected to a valve body (not shown) and a valve spring (not shown) disposed within the container 62. The valve stem 86 extends upwardly through a pedestal 88, such that a distal end 90 extends upwardly, away from the pedestal 88 and is adapted to interact with a valve seat 92 disposed within the actuator 68. A longitudinal axis 94 extends through the valve stem 86. Prior to use, the actuator 68 is placed in fluid communication with the distal end 90 of the valve stem 86. A user may manually or automatically operate the actuator 68 to open the valve assembly, which causes a pressure differential between the container interior and the atmosphere to force the contents out of the container 62, through the valve stem 86 and the actuator assembly 64, and into the atmosphere. It should be noted that the valve stem 86 is shown in a configuration that is not fully seated within the valve seat 92 of the actuator 68, and an additional assembly step is required to fully seat the valve stem 86 therein. Further, while the valve stem 86 is shown as a unitary component with the container 62, the valve stem 86 may be provided in a variety of configurations, and is provided for illustrative purposes only.

Still referring to FIG. 2, the container 62 comprises a lower base 98 that is crimped or otherwise coupled to the body 74 at a bottom end 100 thereof, the body 74 further defining a top end 102 that defines an opening 104. The mounting cup 80 is crimped to a tapered portion of the container 62, which defines the opening 104. The mounting cup 80 seals the top end 102 of the body 74. The crimped portion between the mounting cup 80 and the container 62 defines the seam 78, which provides a location along which the actuator assembly 64 may be attached, as is known in the art.

While any number of pressurized products may be used in the container 62, a preferred composition is pressurized using compressed gas, and includes an alcohol, e.g., ethanol. More particularly, the composition includes between about 4% by volume (% v) and about 15% v ethanol, or between about 6% v and about 13% v ethanol, or between about 8% v and about 11% v ethanol, or at least 5% v ethanol, or at least 7% v ethanol, or at least 8% v ethanol, or at least 9% v ethanol, or at least 10% v ethanol, or at least 11% ethanol. Through testing, it has been determined that the aforementioned levels of ethanol in the composition within the container 62 aid in facilitating evaporation to reduce undesired fallout along various surfaces in the vicinity of the spray. To that end, increasing the amount of ethanol in the composition has been found to speed up or increase the evaporation rate and reduce corrosion of the container 62.

Still referring to FIG. 2, the outer sidewall 76 defines a thickness 108. While the sidewall 76 of the container 62 preferably comprises steel, the sidewall 76 may comprise a wide variety of materials known in the art, such as aluminum or plastic. In a preferred embodiment, the thickness 108 of the sidewall 76 of the container is between about 0.005 in (0.13 mm) and about 0.04 in (1.02 mm), or about 0.01 in (0.25 mm) and about 0.03 in (0.76 mm), or about 0.02 in (0.51 mm), or at least 0.005 in (0.13 mm), or at least 0.01 in (0.25 mm), or at least 0.015 in (0.38 mm), or at least 0.02 in (0.51 mm), or at least 0.025 in (0.64 mm), or at least 0.03 in (0.76 mm). The thickness of the container 62 may be increased in light of the pressure within the container.

As discussed hereinafter, increasing the pressure within the container 62 assists with reducing fallout by dispersing particles of the spray and sending the particles farther from the dispensing system 60 when a user actuates the actuator 68. In some embodiments, the container may have a pressure of between about 120 pounds per square inch (psi) (827 kPa) and about 180 psi (1241 kPa), or between about 130 psi (896 kPa) and about 170 psi (1172 kPa), or between about 140 psi (965 kPa) and about 160 psi (1103 kPa), or between about 150 psi (1034 kPa) and about 155 psi (1068 kPa), or between about 152 psi (1048 kPa) and about 153 psi (1055 kPa), or about 150 psi (1034 kPa), or about 152 psi (1048 kPa), or about 153 psi (1055 kPa), or at least 120 psi (827 kPa), or at least 130 psi (896 kPa), or at least 140 psi (965 kPa), or at least 145 psi (999 kPa), or at least 150 psi (1034 kPa), or at least 155 psi (1068 kPa), or at least 160 psi (1103 kPa), or at least 170 psi (1172 kPa). Still further, at 100% capacity, i.e., completely full, the container 62 may define a headspace of between about 10% and about 70% of the volume of the container 62, or between about 20% and about 60%, or between about 30% and about 50%, or between about 35% and about 45%, or about 40% of the volume of the container 62.

The following includes preferable ranges with respect to particle size of the particles that are sprayed by the dispensing system 60. As noted herein, Dv is a designation of the diameter (measure for particle size) on a volumetric basis. Therefore, Dv (10) represents the $10^{th}$ percentile of the particle size distribution. It is further noted herein that the above particle size range covers a 100% to 25% full can, i.e., a range from 100% full to 25% full. In some embodiments, a Dv(10) particle size of the spray may be between about 5 μm and about 150 μm, or between about 15 μm and about 130 μm, or between about 20 μm and about 120 μm, or between about 23 μm and about 94 μm, or between about 35 μm and about 60 μm, or at least 5 μm, or at least 15 μm, or at least 20 μm, or at least 23 μm, or at least 30 μm, or at least 36 μm. In some embodiments, a Dv(50) particle size of the spray may be between about 10 μm and about 300 μm, or between about 20 μm and about 275 μm, or between about 30 μm and about 250 μm, or between about 55 μm and about 200 μm, or between about 65 μm and about 105 μm, or at least 10 μm, or at least 20 μm, or at least 30 μm, or at least 54 μm, or at least 60 μm, or at least 64 μm. In some embodiments, a Dv(90) particle size of the spray may be between about 30 μm and about 500 μm, or between about 50 μm and about 420 μm, or between about 75 μm and about 400 μm, or between about 105 μm and about 373 μm, or between about 100 μm and about 200 μm, or at least 30 μm, or at least 50 μm, or at least 75 μm, or at least 90 μm, or at least 105 μm.

In some embodiments, a spray rate of the spray measured over about 10 seconds may be between about 0.2 grams per second (g/s) and about 3.5 g/s, or between about 0.8 g/s and about 2.8 g/s, or between about 1.1 g/s and about 2.6 g/s, or between about 1.2 g/s and about 2.0 g/s, or about 1.7 g/s, or at least 0.2 g/s, or at least 0.8 g/s, or at least 1.0 g/s, or at least 1.1 g/s, or at least 1.2 g/s. Unless otherwise noted herein, the various spray rates were measured by weighing the particular dispensing system, spraying for a particular amount of time, weighing the particular dispensing system a second time, and calculating the spray rate based on the differences in weights over the spray time. As noted herein, the above spray rate covers a 100% to 25% full can, i.e., a range from 100% full to 25% full. In some embodiments, a cone angle of the spray (see FIG. 31) may be between about 10° and about 60°, or between about 20° and about 50°, or between about 30° and about 40°, or about 35°, or at least 10°, or at least 20°, or at least 30°, or at least 35°, measured at a vertex of the spray. In some embodiments, a throw distance of the spray may be between about 5 in (12.7 cm) and about 100 in (254 cm), or between about 15 in (38.1 cm) and about 70 in (177.8 cm), or between about 27 in (68.6 cm) and about 45 in (114.3 cm), or about 35 in (88.9 cm), or at least 5 in (12.7 cm), or at least 15 in (38.1 cm), or at least 20 in (50.8 cm), or at least 27 in (68.6 cm), measured from a spray orifice 176 of the nozzle insert 70.

In some embodiments, a spray cone diameter/spray pattern diameter may be between about 0.5 in (12.7 mm) and about 15 in (381 mm), or between about 2.4 in (61.0 mm) and about 6.6 in (168 mm), or between about 3.2 in (81.3 mm) and about 5.1 in (130 mm), or about 4.3 in (109 mm), or at least 0.5 in (12.7 mm), or at least 2.4 in (61.0 mm), or at least 3.2 in (81.3 mm), or at least 4.3 in (109 mm). In other embodiments, the spray cone diameter/spray pattern diameter may be between about 2.4 in (61.0 mm) and about 12.5 in. (318 mm), or between about 5.0 in (127 mm) and about 9.5 in (241 mm). In some embodiments, a particle velocity of the spray may be between about 10 meters per second (m/s) and about 90 m/s, or between about 30 m/s and about 70 m/s, or between about 40 m/s and about 57 m/s, or at least 10 m/s, or at least 30 m/s, or at least 35 m/s, or at least 40 m/s, measured at the spray orifice 176 of the nozzle insert 70. As noted herein, the above particle velocity covers a 100% to 25% full can. In a preferred embodiment, the Dv(10) is between about 36 μm and about 58 μm, the Dv(50) is between about 64 μm and about 105 μm, the Dv(90) is between about 105 μm and about 220 μm, the spray rate is between about 1.1 g/s and about 2.6 g/s, the potential cone angle is about 35°, the throw distance is between about 27 in (68.6 cm) and about 45 in (114 cm), the spray pattern is between about 3.2 in (8.13 cm) and about 5.1 in (13.0 cm), the particle velocity is between about 40 m/s and about 57 m/s. In preferred embodiments, the composition is 9% by volume ethanol.

Referring now to FIGS. 3-8, the actuator assembly 64 is shown in greater detail. The actuator assembly 64 is shown in a highest (non-actuated) or first configuration in FIGS. 3-5, 7, and 9, and the actuator assembly 64 is shown in a lowest (actuated) or second configuration in FIGS. 5 and 7. The non-actuated or first configuration of FIGS. 3-5, 7, and 9 may be considered a transport or pre-activation configuration, and a post-activation configuration includes the actuator 68 being disposed at a point intermediate the first configuration and the second configuration, such that the actuator 68 is configured for actuation. The actuator assembly 64 includes the actuator 68, which is configured to receive at least part of the nozzle insert 70 into a portion thereof. In some embodiments, the actuator 68 may be fabricated from a unitary piece of material, and more specifically, a plastic material. In some embodiments, the actuator 68 may be fabricated from a co-polymer, e.g., a polypropylene co-polymer. In some embodiments, the actuator 68 may be fabricated from polypropylene, propylene, HDPE, nylon, or other co- or homo-polymers.

Figure 3:
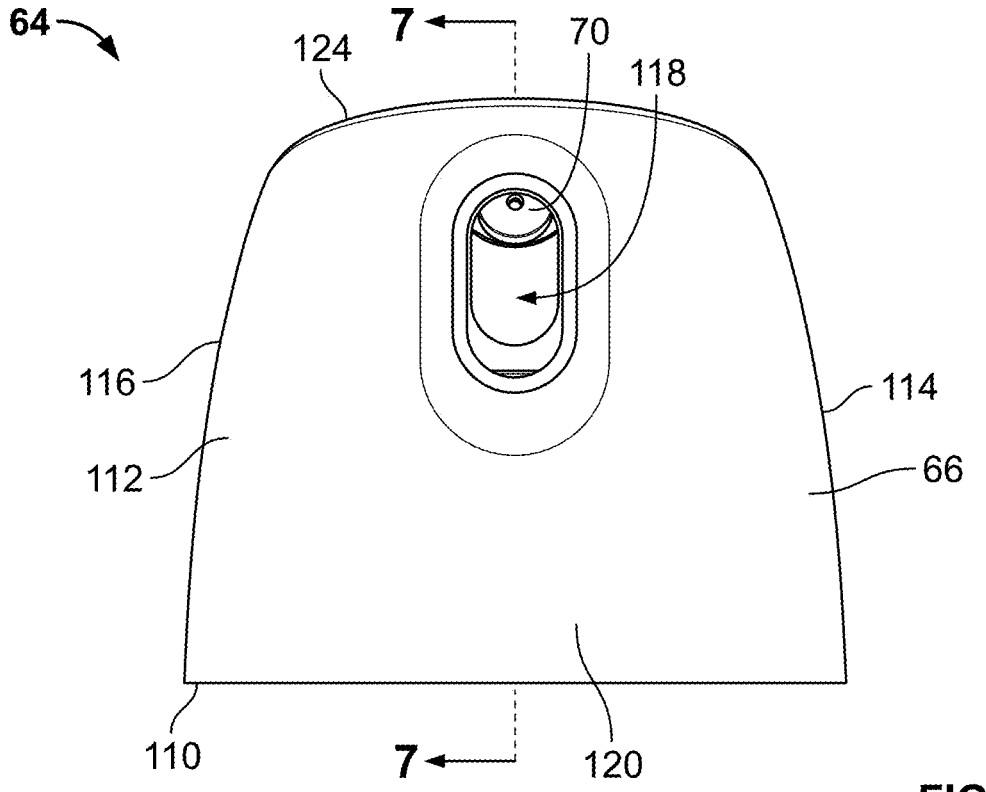
FIG. 3 is a front elevational view of the actuator assembly of FIG. 1.

Referring specifically to FIGS. 3-6, the housing 66 is shown in detail. The housing 66 includes a lower edge 110 from which a continuous outer wall 112 extends upward and inward, bowing toward the longitudinal axis 94 of the valve stem 86. Referring to the front view of FIG. 3, a left side 114 and a right side 116 of the outer wall 112 bow inward and define a slightly curved outer wall 112. A racetrack-shaped front opening 118 is provided along a front side 120 of the housing 66, the front opening 118 allowing for the nozzle insert 70 to travel up and down therealong and dispense product therethrough, from the first configuration (non-actuated) to the second configuration (fully actuated). The opening 118 may take a variety of shapes and need not be limited to the embodiment shown herein. It should be noted that FIG. 3 illustrates the actuator assembly 64 in a configuration that is uncoupled with the valve stem, and an additional assembly step of depressing the actuator 68 fully seats the actuator 68 on the valve stem 86.

Figure 4:
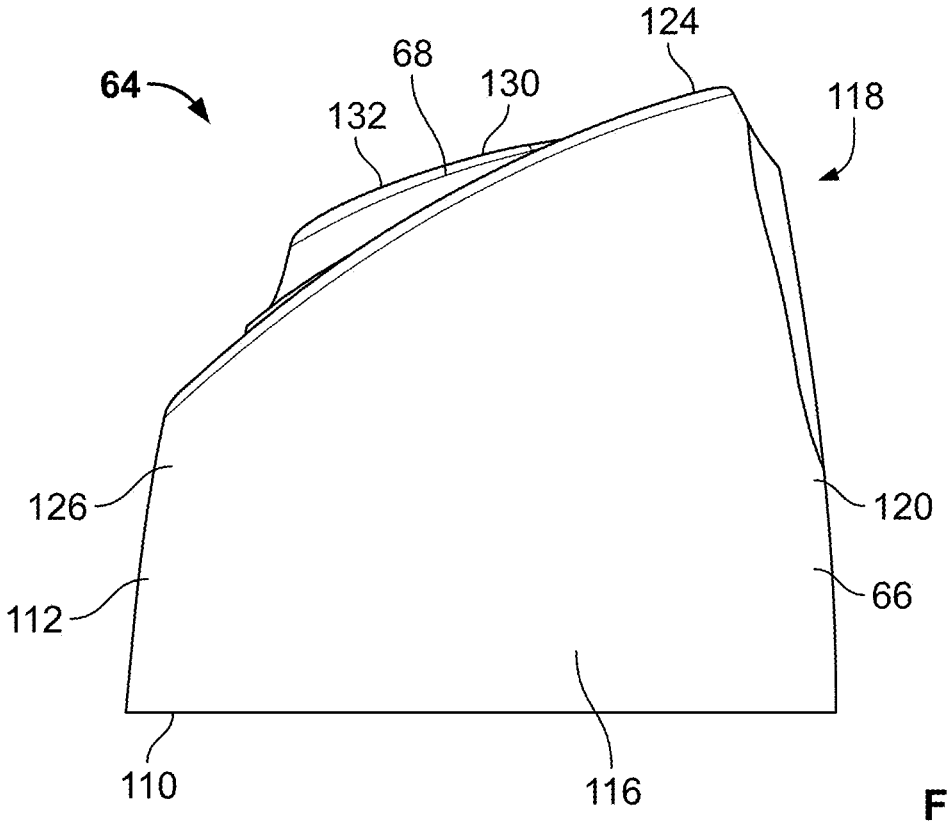
FIG. 4 is a left side elevational view of the actuator assembly of FIG. 1, with an actuator shown in a non-actuated or first configuration.
Figure 5:
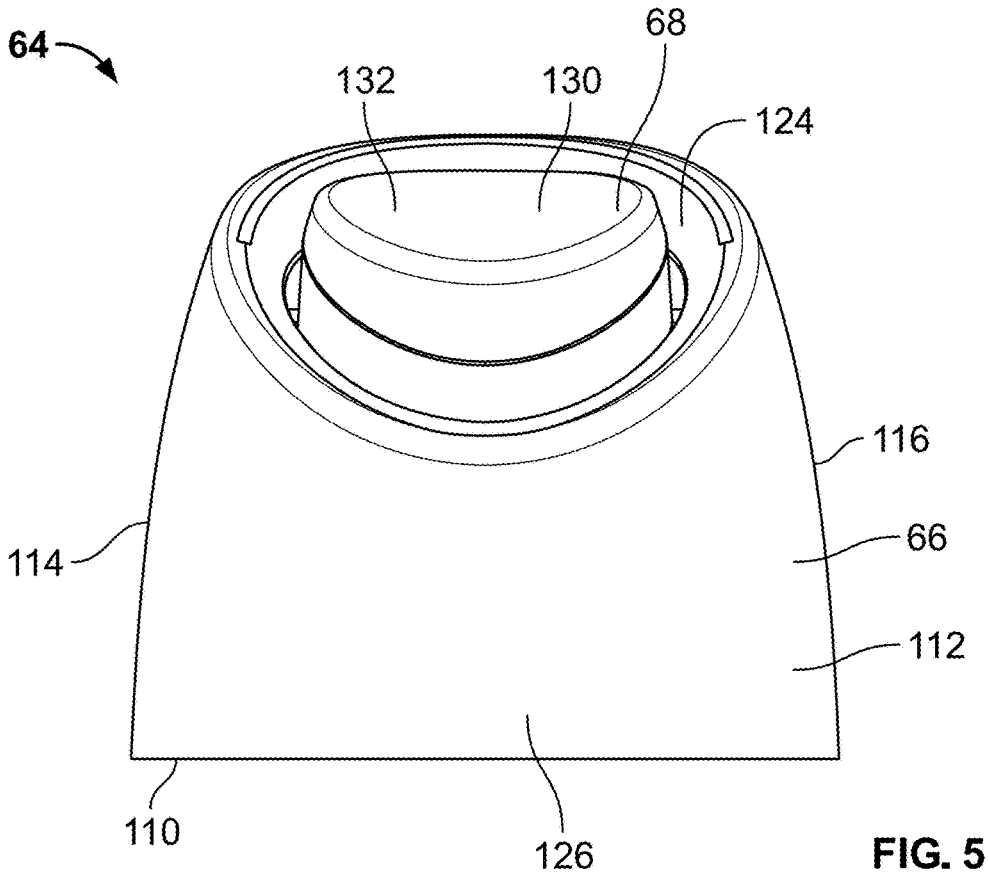
FIG. 5 is a rear elevational view of the actuator assembly of FIG. 1.
Figure 6:
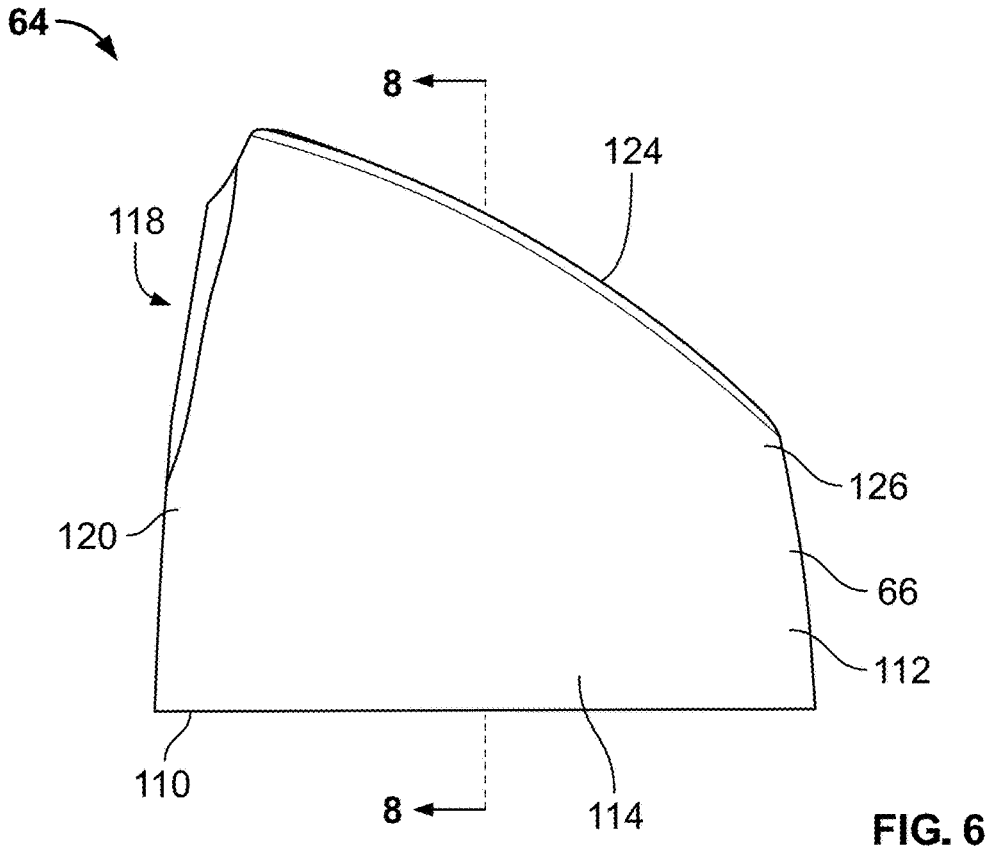
FIG. 6 is a right side elevational view of the actuator assembly of FIG. 1, with the actuator shown in an actuated or second configuration.

Referring to the side view of FIG. 4 and the rear view of FIG. 5, the actuator 68 is shown extending upward, above a top wall 124 of the housing 66. As further shown in FIG. 5, a rear side 126 of the housing 66 is relatively shorter than the front side 120 of the housing 66, and the top wall 124 extends between the rear side 126 and the front side 120. The top wall 124 is curved or bowed and extends upward from the rear side 126 to the front side 120. Since the actuator assembly 64 is shown in the first configuration in FIGS. 4 and 5, the actuator 68 is in a highest state in these figures, and extends above the top wall 124 when viewed from the side. Referring specifically to FIG. 5, the top wall 124 is shown in more detail, and it extends peripherally about the actuator 68 and is inwardly and downwardly angled, toward the longitudinal axis 94. The actuator 68 also includes a button 130 defining a concave top wall 132, which curves downward from left to right, and from front to back. The button 130 is configured to interact with a thumb or finger of a user, such that the button 130 can be depressed to actuate the dispensing system 60. Referring to the side view of FIG. 6, the actuator assembly 64 is shown in the second configuration, such that the actuator 68 is fully depressed and is not visible from the side.

Figure 7:
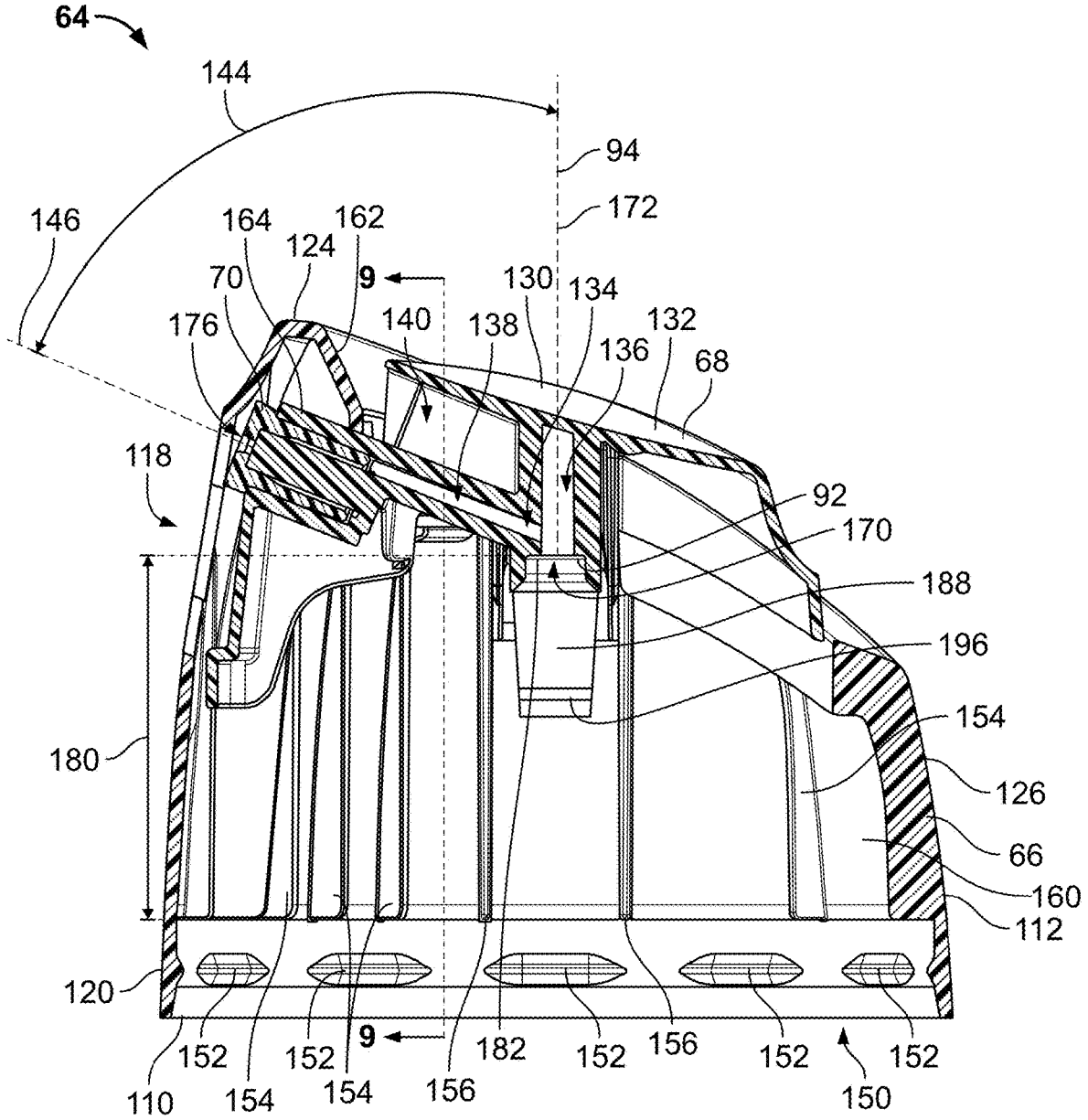
FIG. 7 is a side cross-sectional view of the actuator assembly shown in a first configuration and taken through line 7-7 of FIG. 3.

Referring to FIG. 7, the actuator 68 is shown in the first configuration, and is at least partially disposed within the housing 66. The nozzle insert 70 is further shown, which is disposed within a fluid passageway 134 of the actuator 68. The fluid passageway 134 defines a vertical conduit 136 and an angled conduit 138 that intersects with the vertical conduit 136. The vertical conduit 136 is a chamber that allows formula to accumulate between sprays and may be included to reduce material from an otherwise thick section of the actuator 68. In some embodiments, the vertical conduit 136 may be substantially shorter, and an actuator cavity 140, shown above the angled conduit 138, may extend above the shorter vertical conduit 136. The actuator cavity 140 is an open space along an underside of the button 130.

A spray angle 144 is further shown in FIG. 7, which defines an angle with respect to the longitudinal axis 94 and a spray axis 146. The spray angle 144 may be between about 45° and about 85°, or between about 50° and about 80°, or between about 55° and about 75°, or between about 60° and about 70°, or at most 80°, or at most 75°, or at most 70°, or at most 68°, or about 66°, or about 67°, or about 68°, or about 69°, or about 70°, or about 71°. The preferred angle ranges disclosed herein allow for reducing fallout by spraying the composition at an angle that increases the distance between the spray and the ground surface. As discussed below, the spray angle 144 may be noted with respect to an angle that is offset from a horizontal plane (not shown), which is located orthogonally with respect to the longitudinal axis 94. As such, the angles disclosed above may be discussed with a horizontal plane as a frame of reference.

Still referring to FIG. 7, the housing 66 further includes a lower opening 150 adjacent the lower edge 110 for receiving portions of the container 62. The housing 66 further includes a plurality of outwardly extending securement ribs 152, stabilizing ribs 154, and alignment ribs 156 that are disposed along an interior surface 160 of the outer wall 112. The securement ribs 152 are oriented in a manner substantially parallel with the lower edge 110. Any number and size of securement ribs 152 may be included that circumscribe the interior surface 160 of the actuator 68 to assist in attaching the actuator 68 to the container 62. The stabilizing ribs 154 are provided about the interior surface 160 of the outer wall 112 to assist with stability of the actuator assembly 64, especially when forces are applied thereto. As discussed below, the alignment ribs 156 also act as stabilizing ribs, but are provided in particular locations to assist with alignment of the actuator 68 during assembly, and to retain the actuator 68 in a non-rotatable configuration during use of the dispenser 60.

An inner wall 162 is also shown in FIG. 7, which extends downward from the top wall 124 of the housing 66. The inner wall 162 includes surfaces that interact with the actuator 68, e.g., along the front side 120 of the housing 66. As shown in FIG. 7, the inner wall 162 is configured to prevent upward movement of the actuator 68 when the actuator 68 is disposed within the housing 66 by preventing upward movement of a nozzle barrel 164 of the actuator 68. The plurality of securement ribs 152 are further shown along the interior surface 160 of the housing 66, which are spaced apart, and assist with attachment of the container 62 to the actuator assembly 64, as is known in the art.

Still referring to FIG. 7, the plurality of stabilizing ribs 154 are shown, which circumscribe the interior surface 160 of the outer wall 112, as noted above. The stabilizing ribs 154 may provide additional structural integrity to the housing 66 for allowing increased top-loads on the actuator 68. Specifically, bottom surfaces of the stabilizing ribs 154 interact with portions of the container 62 to assist in spreading forces exerted on upper portions of the actuator 68 about the container 62. Further, the alignment ribs 156, which are disposed along sides and the front of the housing 66, assist in aligning and positioning the actuator 68 in the proper position during and/or after the capping process. Such alignment assistance helps to ensure that the actuator assembly 64 is positioned correctly onto the valve stem 86. The alignment ribs 156 generally extend farther toward the longitudinal axis 94 than the stabilizing ribs 154. In some embodiments, the stabilizing ribs 154 and the alignment ribs 156 are substantially identical in form, and there may be more or fewer ribs 154, 156.

The assembled actuator 68 is seated and retained on the container 62 as noted above, i.e., the ribs 154, 156 of the actuator 68 interact with the seam 78 of the container 62 to secure the actuator 68 to the container 62 in a snap-fit type manner. In this condition, the actuator 68 of the actuator assembly 64 extends upwardly through the actuator 68 and out through an opening 166 disposed in the top wall 132 of the actuator 68. When seated properly, the actuator 68 extends up through the opening 166 to create a surface in which a user can apply pressure to effectuate the actuation process. Further, in this condition the valve stem 86 of the container 62 is seated within an inlet orifice 170 of the actuator 68, whereby surfaces defining the inlet orifice 170 and the vertical conduit 136 provide a substantially fluid tight seal therebetween.

The actuator 68 and the nozzle insert 70 are also shown in FIG. 7 in an assembled configuration. The actuator 68 defines a chamber axis 172, which extends along the vertical conduit 136, and is coextensive with the longitudinal axis 94 discussed above in FIG. 2. When seating the actuator assembly 64 onto the container 62, the chamber axis 172 is generally aligned with the longitudinal axis 94 and the nozzle insert 70 is inserted into an insert cavity 174 of the actuator 68. The spray orifice 176 of the nozzle insert 70 is shown disposed at or slightly below an upper end of the front opening 118 of the housing 66, but once the actuator 68 is in an activated configuration, the spray orifice 176 is disposed such that aerosolized fluid exits the spray orifice 176, through the front opening 118. The valve seat 92 is shown within the actuator 68, the valve seat 92 defining a seat height 180, which is a height measured from lower edges of the stabilizing ribs 154 to an upper surface 182 of the valve seat 92. The valve seat 92 receives the valve of the container 62, and defines the inlet orifice 170 into the fluid passageway 134 of the actuator 68 through which product is dispensed.

Figure 8:
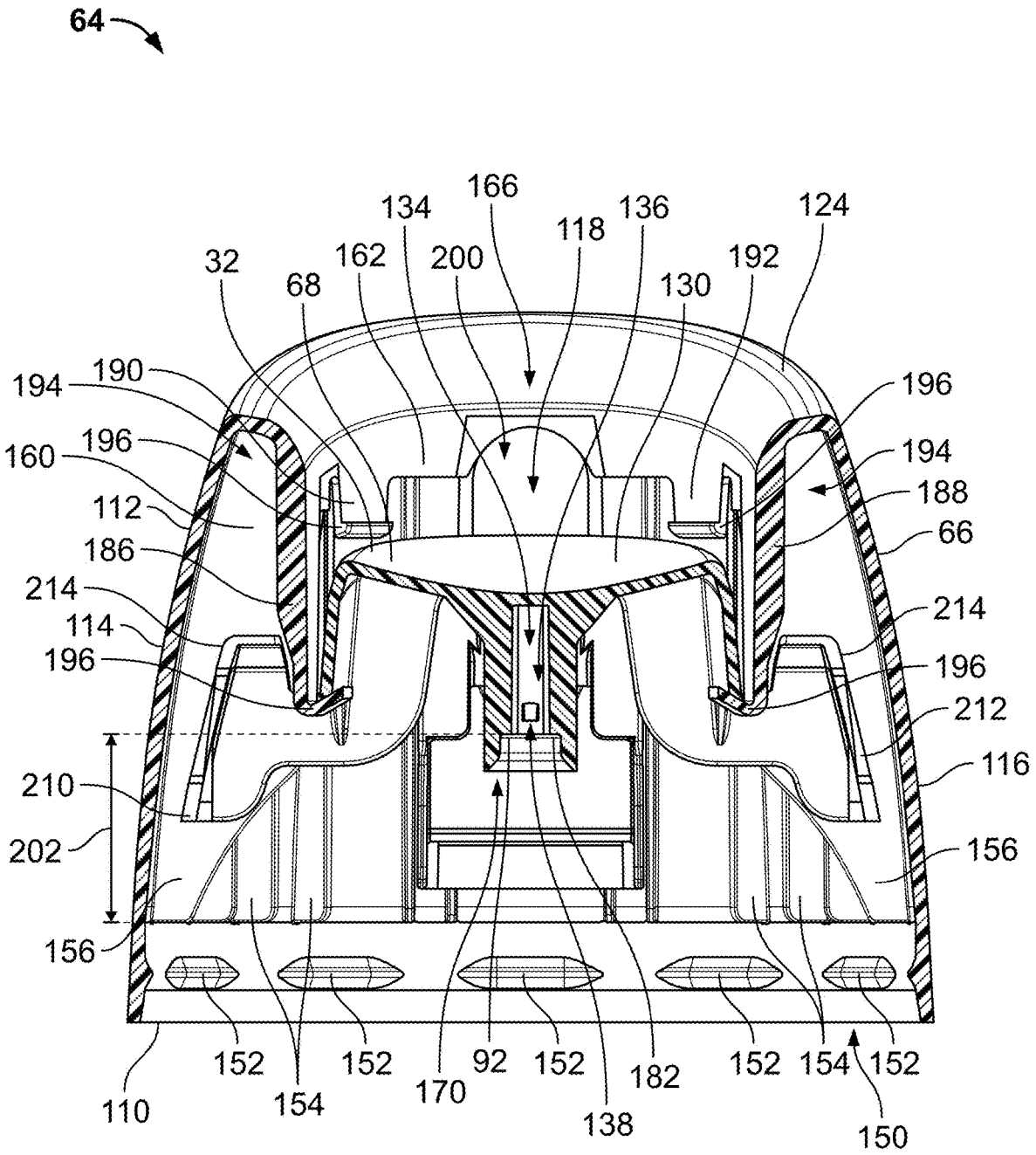
FIG. 8 is a rear cross-sectional view of the actuator assembly shown in the second configuration and taken along line 8-8 of FIG. 6.

Referring now to FIG. 8, a rear cross-sectional view of the actuator assembly 64 is shown in the second configuration, i.e., in an actuated state. Internal aspects of the housing 66 are shown in detail, such as a first or left retaining arm 186, a second or right retaining arm 188, a first or left shipping lock 190, and a second or right shipping lock 192. Each of the arms 186, 188, and the shipping locks 190, 192 depend downward from and are integral with the inner wall 162 of the housing 66. Further, an inner cavity 194 is shown, which is defined as the space between the inner wall 162 and the outer wall 112 of the housing 66. Each of the arms 186, 188, and shipping locks 190, 192 further include an inwardly-disposed catch or hook 196, which have varying purposes. For example, the catches 196 of the first and second retaining arms 186, 188 are configured to prevent over actuation of the actuator 68, as shown in FIG. 8, while the catches 196 of the first and second shipping locks 190, 192 interact with detents 198 along the actuator 68 (see FIG. 9) to keep the actuator 68 separated from the valve stem 86 during capping.

The inner wall 162 is further shown as defining a semi-circular notch 200 along the front side 120 of the housing 66, which is configured to receive the nozzle barrel 164 of the actuator 68 (see FIG. 7). The notch 200 and the first and second retaining arms 186, 188 therefore act in conjunction to prevent the actuator 68 from exiting an actuator profile, while the alignment ribs 156 prevent rotation of the actuator 68. A second height 202 is also shown in FIG. 8, which is defined as a distance from the lower edges of the stabilizing ribs 154 to the upper surface 182 of the valve seat 92. The second height 202 may be between about 20% and about 100% of the first height 180, or between about 30% and about 90% of the first height 180, or between about 40% and about 80% of the first height 180, or between about 50% and about 60% of the first height 180. The vertical conduit 136 of the fluid passageway 134 of the actuator 68 is further shown, along with an entryway into the angled conduit 138 of the fluid passageway 134. A curvature of the button 130 is also shown in detail.

Still referring to FIG. 8, a left arm 210 and a right arm 212 of the actuator 68 are shown, which are each disposed within the inner cavity 194 of the housing 66. The left and right arms 210, 212 define angled walls 214 along outer portions thereof, which follow a profile of portions of the outer wall 112 of the housing 66. When the actuator 68 is biased upward by the valve assembly 84, the left and right arms 210, 212 of the actuator 68 extend farther upward into the inner cavity 194, and remain nested therein. To assemble the actuator 68 to the housing 66, the actuator 68 is inserted through the lower opening 150 and the retention arms 186, 188 are inserted through arm openings 216 (see FIG. 19) within the actuator 68 until the catches 196 of the retention arms 186, 188 snap into place, as shown in FIG. 8. The retention arms 186, 188 of the housing 66 therefore flex out of the way during assembly, and capture the actuator 68 once assembled. Once the catches 196 of the retention arms 186, 188 are seated along an underside of the actuator 68, i.e., translated at least as high as shown in FIG. 8, the actuator assembly 64 is capable of being assembled to the container 62.

Figure 9:
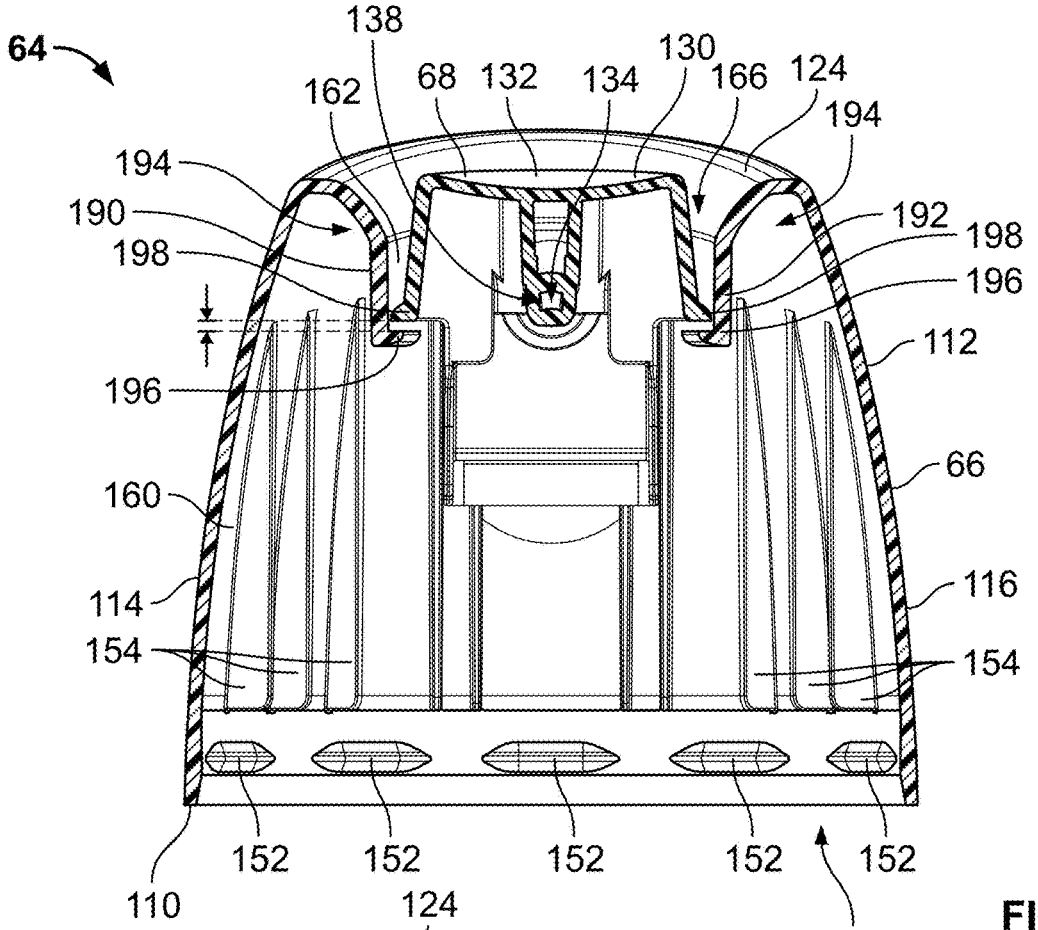
FIG. 9 is a rear cross-sectional view of the actuator assembly shown in the first configuration and taken through line 9-9 of FIG. 7.
Figure 10:
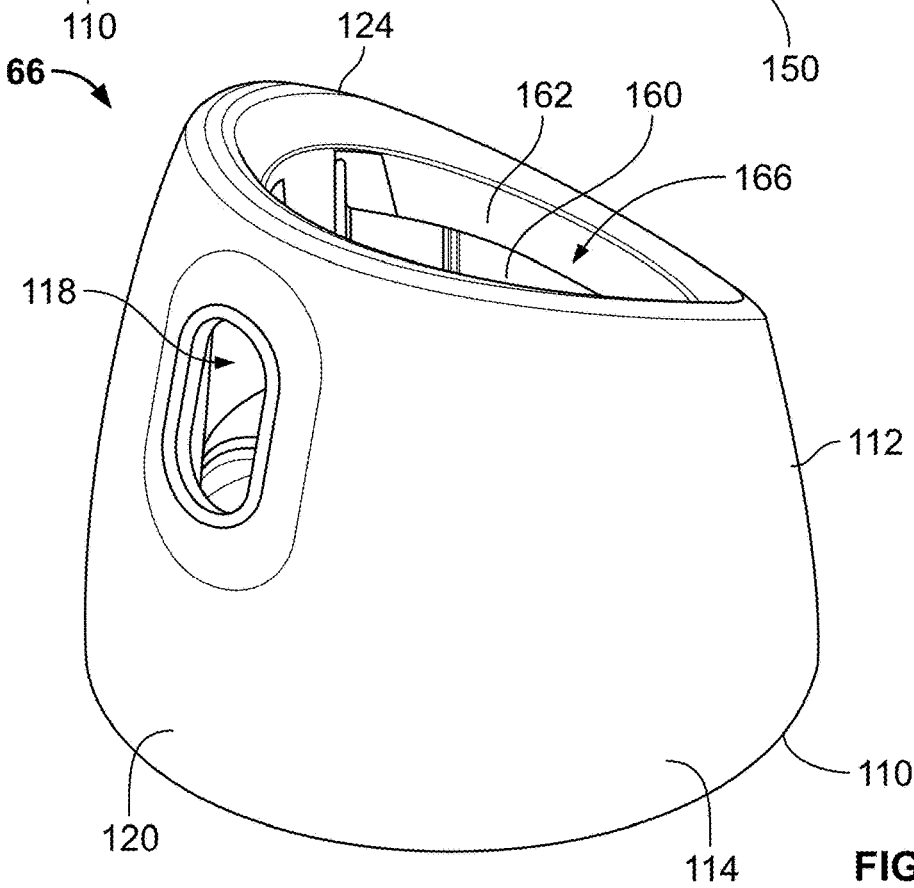
FIG. 10 is a front isometric view of a housing of the actuator assembly of FIG. 1.

Referring now to FIG. 9, another cross-sectional view of the actuator assembly 64 is shown, which illustrates the shipping locks 190, 192 of the housing 66 and the detents or locking tabs 198 of the actuator 68. The shipping locks 190, 192 hold the actuator 68 during shipping so that it is not in contact with the valve stem 86 during capping and transit. During a first use of the dispenser 60, a consumer overcomes the shipping locks 190, 192 and thereafter, the actuator 68 is seated onto the valve stem 86. To that end, the shipping locks 190, 192 are provided to retain the actuator 68 until a first use of the dispenser 60. The angled conduit 138 of the fluid passageway 134 is also shown in FIG. 9, along with the various stabilizing ribs 154 and alignment ribs 156.

Figure 11:
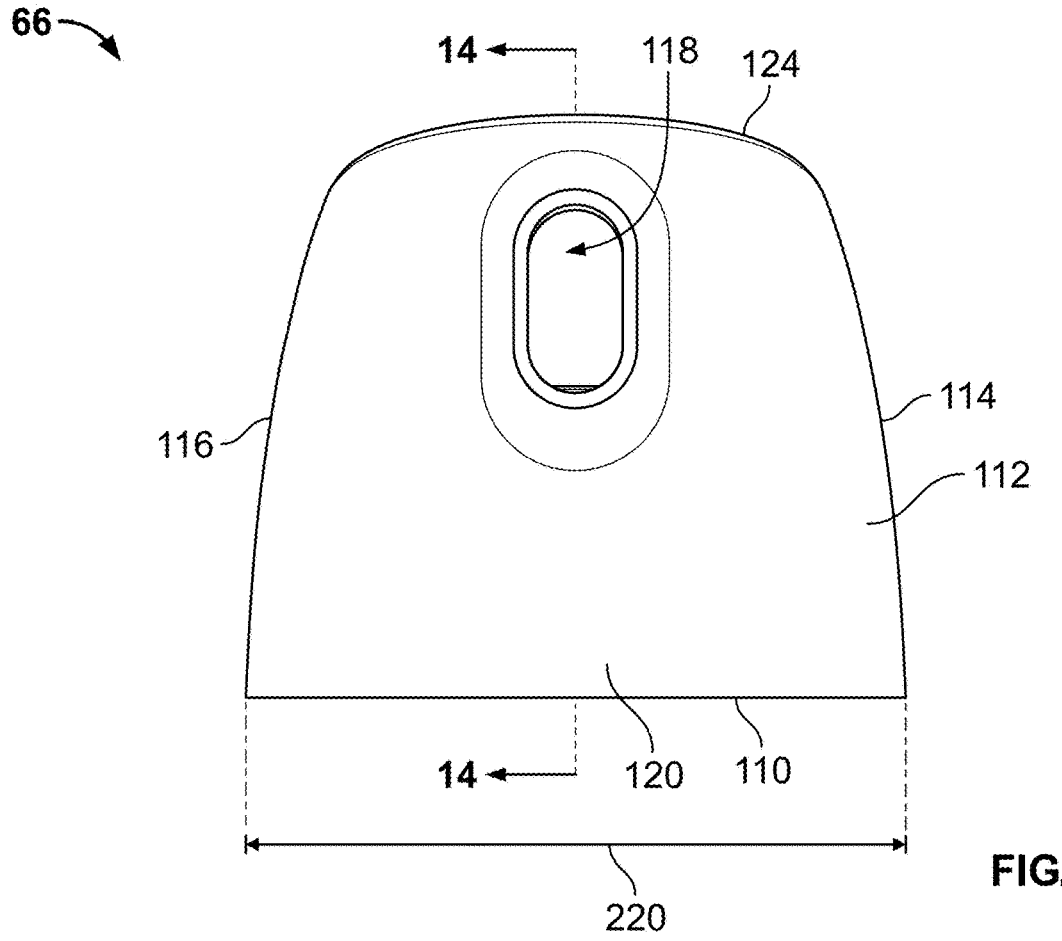
FIG. 11 is a front elevational view of the housing of FIG. 10.
Figure 12:
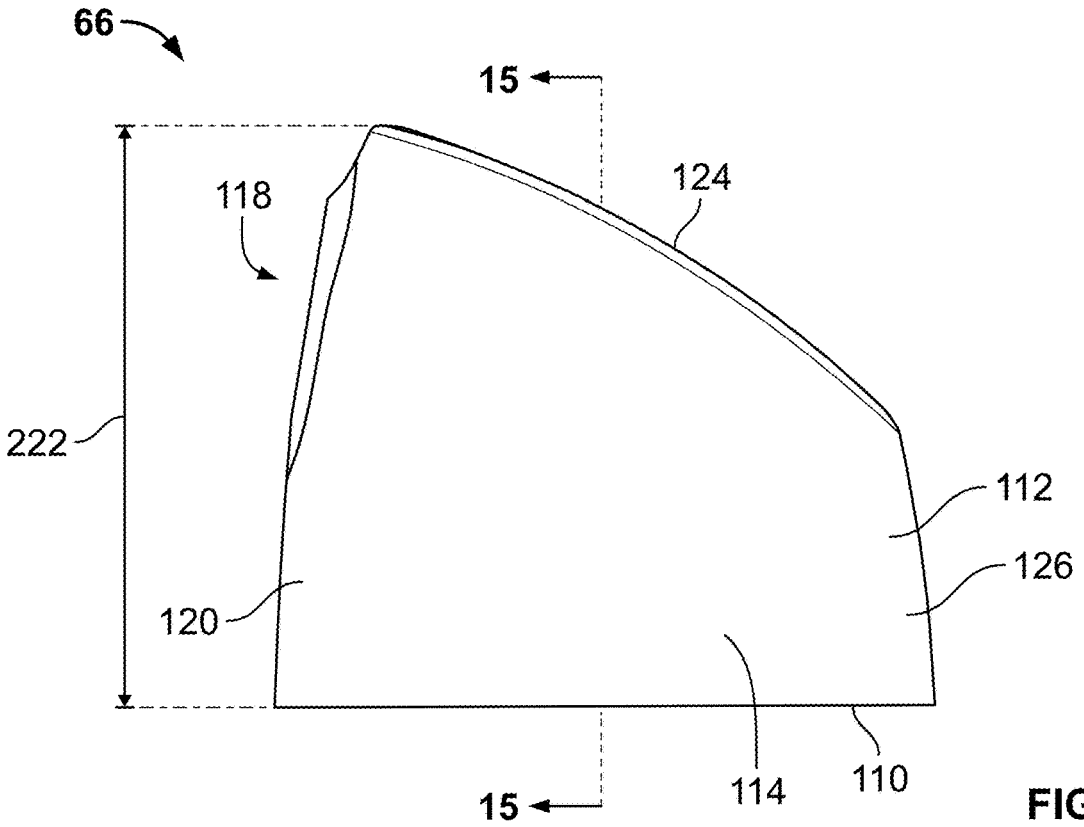
FIG. 12 is a side elevational view of the housing of FIG. 10.
Figure 13:
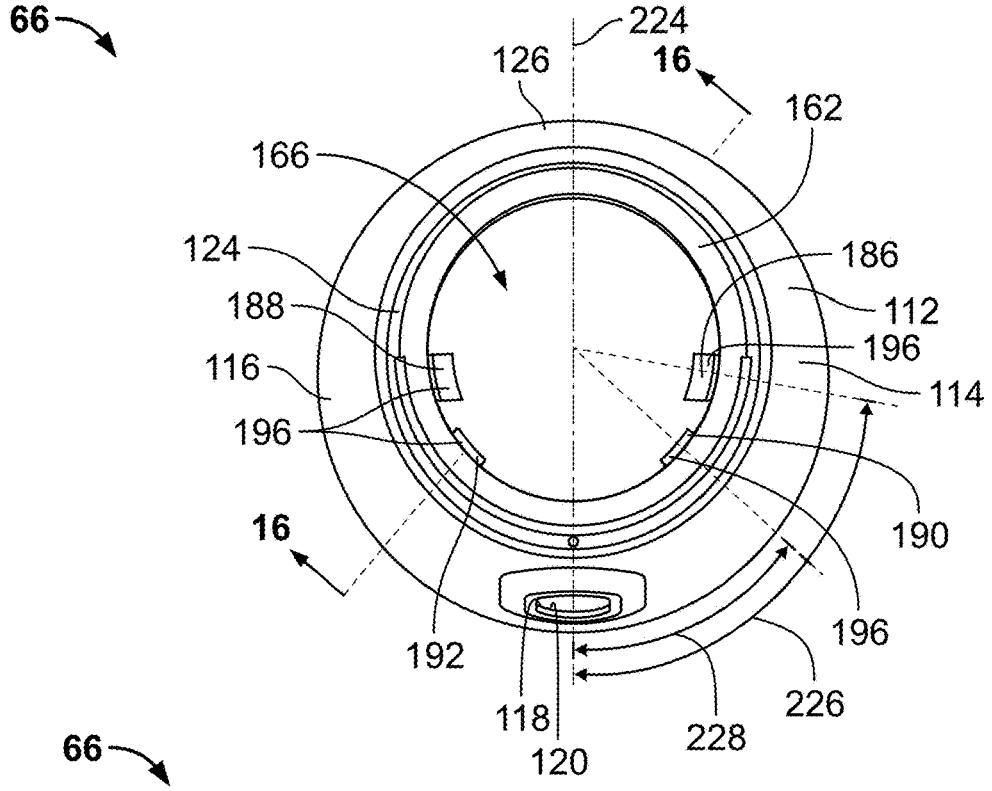
FIG. 13 is a top plan view of the housing of FIG. 10.

FIGS. 10-16 illustrate aspects of the housing 66 in greater detail, in particular, without the actuator 68 shown disposed therein. The various ribs 152, 154, 156 are shown unobstructed, along with the front opening 118 of the housing 66. Referring specifically to FIGS. 11 and 12, a housing width 220 and a housing height 222 are shown. The housing height 222 may be between about 50% and about 150% of the housing width 220, or between about 70% and about 130% of the housing width 220, or between about 90% and about 110% of the housing width 220, or about 100% of the housing width 220. FIG. 13 illustrates a vertical plane 224 that extends centrally through the housing 66, and passes through the longitudinal axis 94 of the actuator assembly 64 when it is seated on the container 62. The arms 186, 188 are shown being disposed offset by a first angle 226 with respect to the vertical plane 224, while the locks 190, 192 are shown being offset by a second angle 228, which is less than the first angle 226, taken with respect to an intersection of the vertical plane 224 with the longitudinal axis 94.

Figure 14:
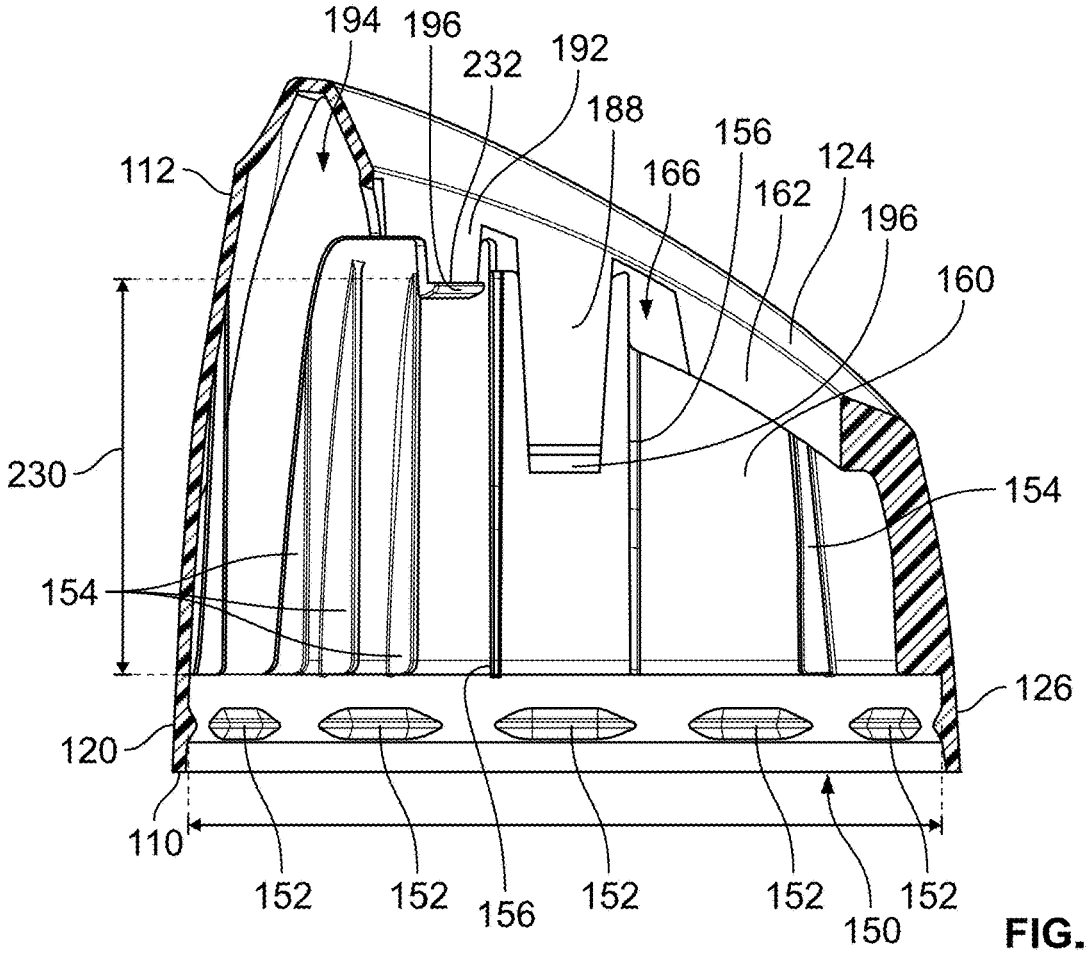
FIG. 14 is a side cross-sectional view of the housing taken through line 14-14 of FIG. 11.
Figure 15:
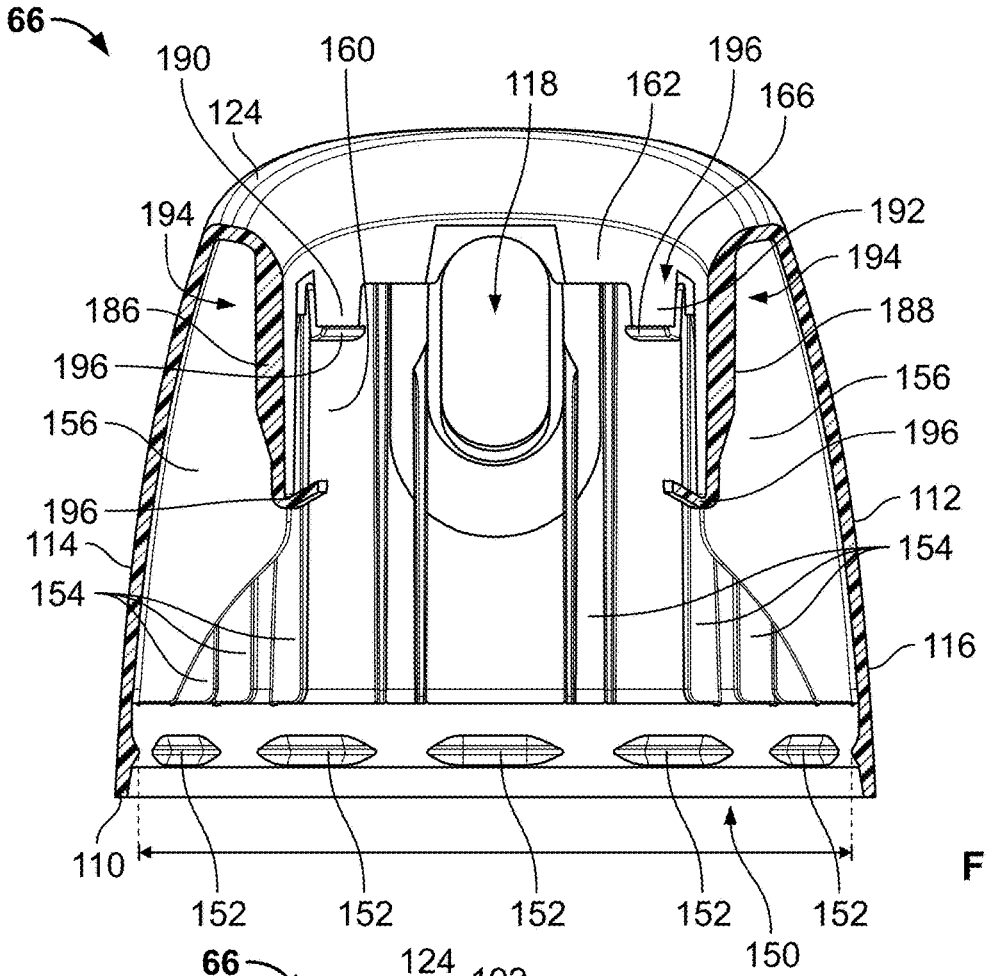
FIG. 15 is a rear cross-sectional view of the housing taken through line 15-15 of FIG. 12.
Figure 16:
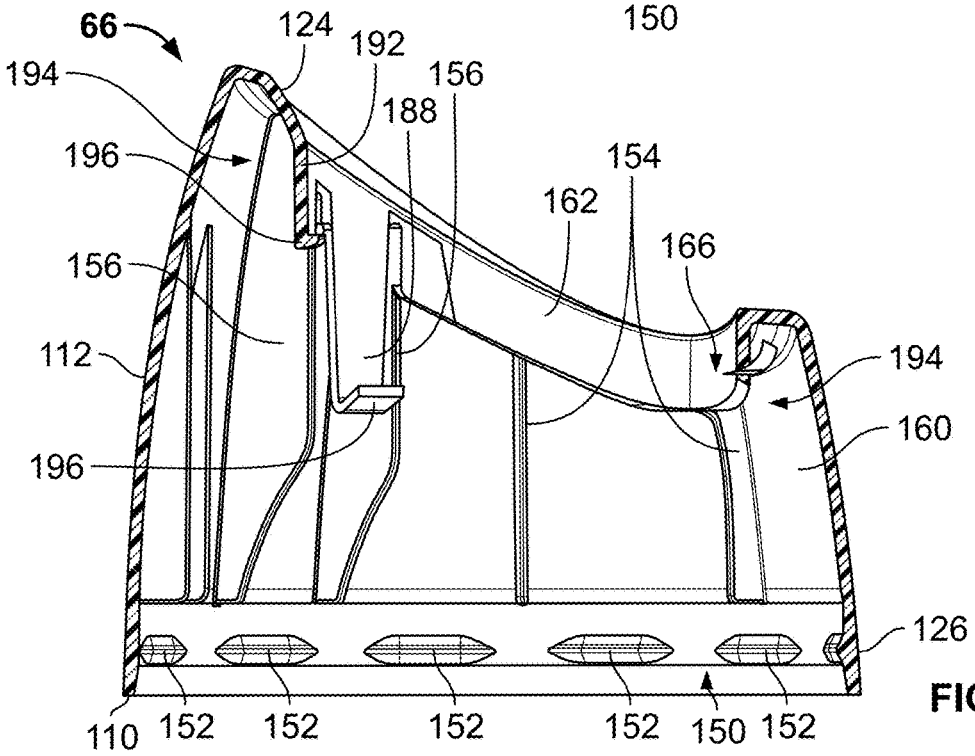
FIG. 16 is an angled, side cross-sectional view of the housing taken through line 16-16 of FIG. 13.
Figure 17:
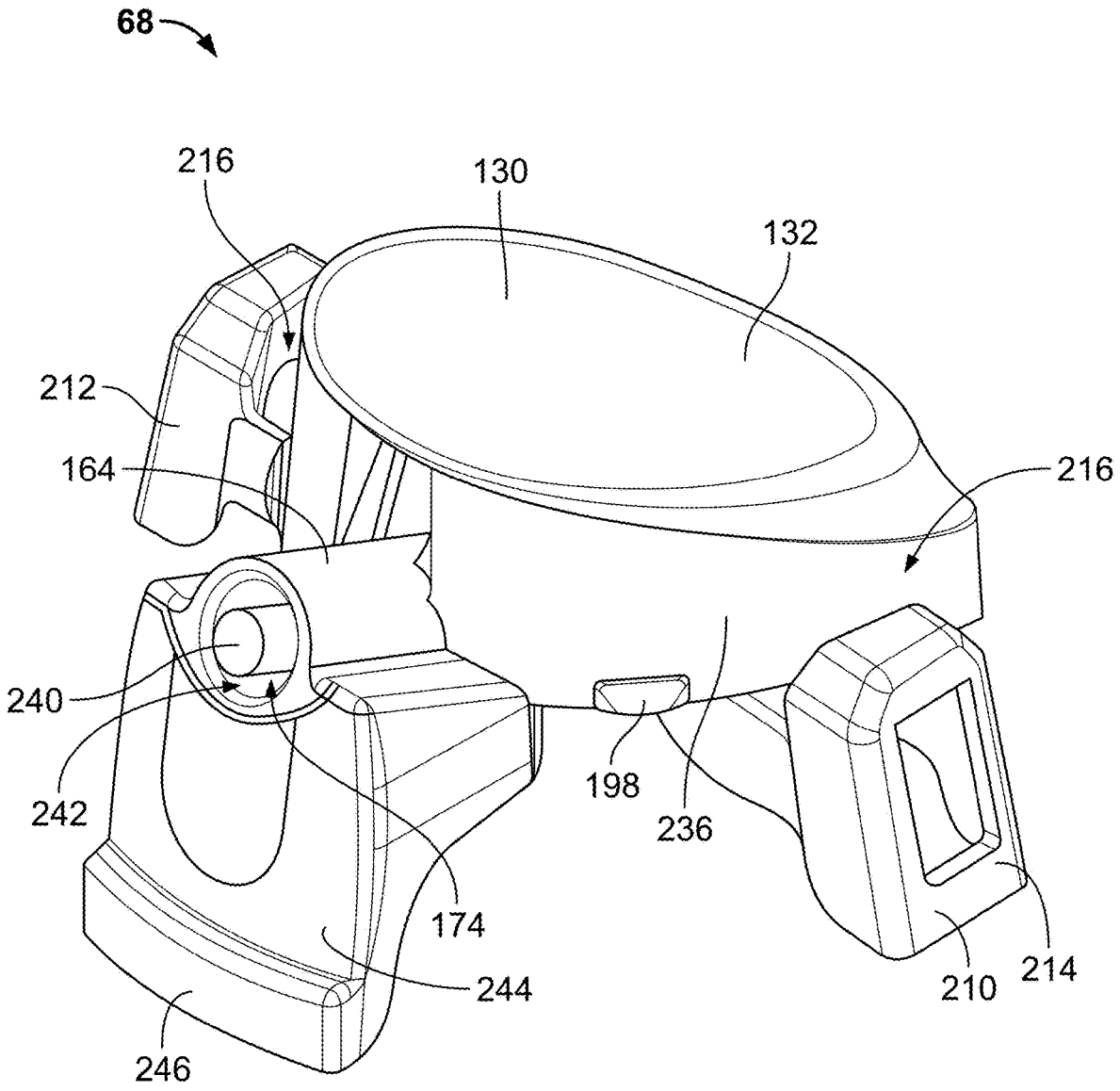
FIG. 17 a front isometric view of an actuator of the actuator assembly of FIG. 1.

Referring to FIG. 14, the housing 66 is shown in cross-section taken through the vertical plane 224. The right shipping lock 192 and the right retention arm 188 are shown in detail. A lock height 230 is shown, which defines a distance from the lower edge 110 of the stabilizing ribs 154 to an upper surface 232 of the catch 196 of the shipping locks 190, 192. The catch 196 of the right retention arm 188 is also shown, in detail. As noted above, the arms 186, 188, and shipping locks 190, 192 extend downward from the inner wall 162 of the housing 66, and partially define the interior cavity 194 thereof. The alignment ribs 156 are also shown, i.e., the ribs that are disposed along opposing sides of the retaining arms 186, 188. The alignment ribs 156 are positioned to prevent rotational movement of the actuator 68, and retain the right and left arms 186, 188 therebetween. FIGS. 15 and 16 provide additional views of inner aspects of the housing 66, including views of the various ribs 154, 156 and the various arms 186, 188, and shipping locks 190, 192 that extend downward and are configured for suspending or retaining the actuator 68. Referring specifically to FIG. 15, the inner cavity 194 is shown being disposed along both the front side 120 and the rear side 126 of the housing 66. The inner cavity 194 is generally interrupted by the stabilizing ribs 154 and the alignment ribs 156, but otherwise extends about the entire housing 66.

Referring now to FIGS. 17-24, the actuator 68 is shown in more detail. In particular, and referring to FIG. 17, an isometric view of the actuator 68 of the actuator assembly 64 is shown. The actuator 68 includes the button 130 defining the top wall 124 and a rounded peripheral wall 236, the left arm 210, and the right arm 212, which each extend outward from the button 130. As noted above, the left arm 210 and the right arm 212 are configured to slidably translate within the interior cavity 194 between the alignment ribs 156 along opposing sides of the housing 66. The arm openings 216 are provided within the left arm 210 and the right arm 212 of the actuator 68, which receive the left retaining arm 186 and the right retaining arm 188 of the housing 66, respectively. The nozzle barrel 164 of the actuator 68 is shown in greater detail, along with a post 240 that is disposed within the fluid passageway 134, and, in combination with the nozzle barrel 164, defines a nozzle conduit 242, which receives the nozzle insert 70. A front wall 244 depends downward from the nozzle barrel 164, and a front tab 246 extends therefrom, which may be configured to interact with the housing 66 to prevent over actuation of the actuator 68. The locking tabs or detents 198 are further shown, which extend from the peripheral wall 236 of the actuator 68.

Figure 18:
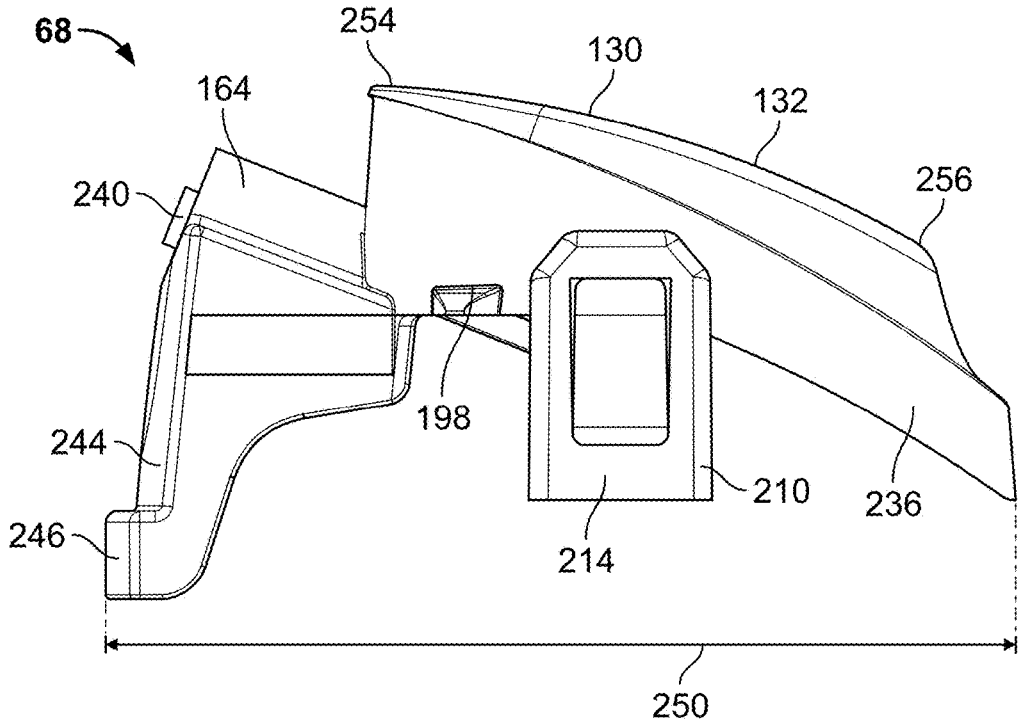
FIG. 18 is a side elevational view of the actuator of FIG. 17.
Figure 19:
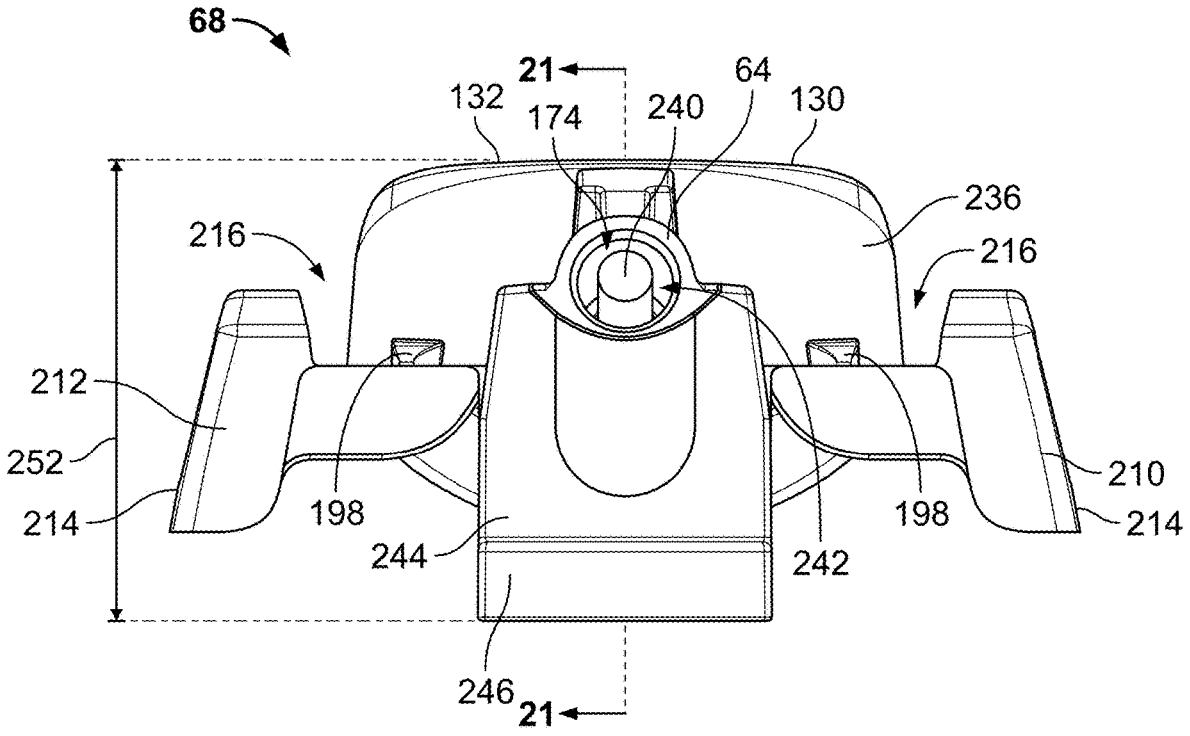
FIG. 19 is a front elevational view of the actuator of FIG. 17.

Referring now to FIGS. 18 and 19, an actuator depth 250 and an actuator height 252 are shown. Referring specifically to FIG. 18, the upper wall 132 of the actuator 68 is shown, and curves downward from a front end 254 to a rear end 256 thereof. The post 240 is further shown protruding slightly outward from the nozzle conduit 242. The front wall 244 is also shown, along with the front tab 246 which defines the forward most point of the actuator 68. Referring now to FIG. 19, both of the arms 210, 212 and both of the locking tabs 198 are shown in greater detail. The angled profile of the arms 210, 212 is clear in FIG. 19, along with the symmetric nature of the actuator 68. The apertures 216 defined between the left and right arms 210, 212 and the button 130 are further shown, which provide clearance for the left and right stabilizing arms 186, 188 to be inserted therethrough during assembly of the actuator assembly 64.

Figure 20:
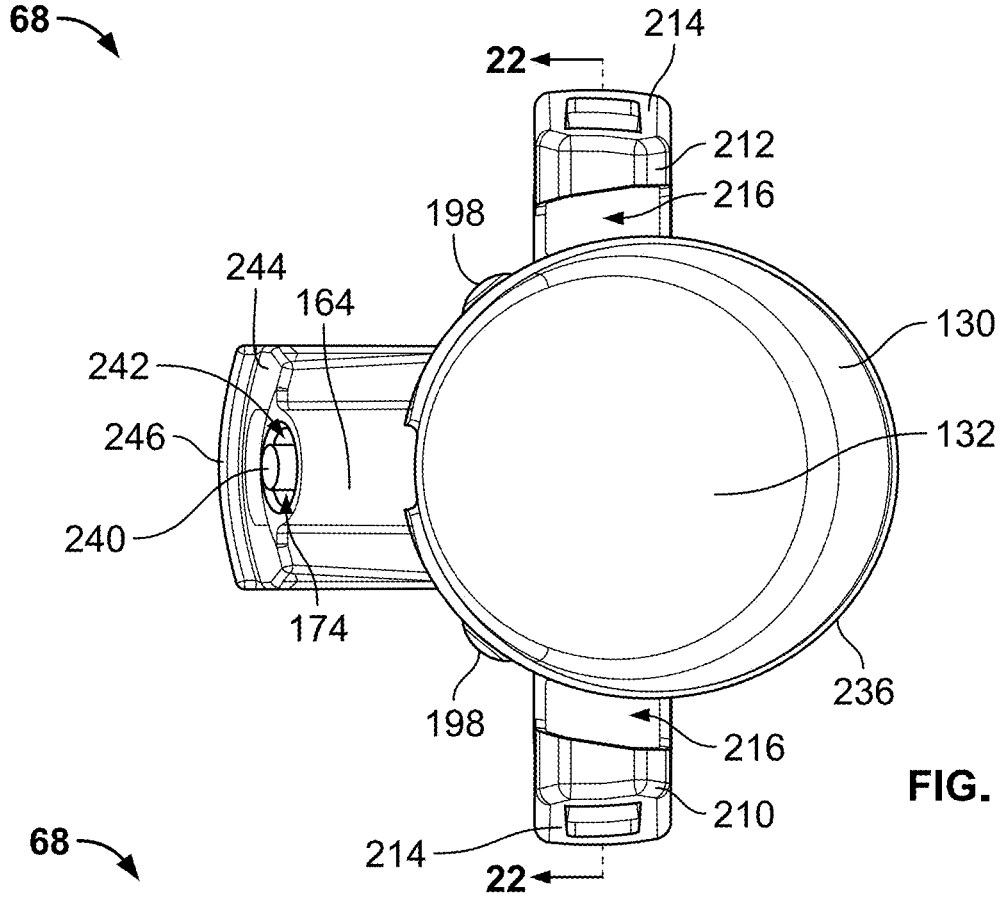
FIG. 20 is a top plan view of the actuator of FIG. 17.

Referring now to FIG. 20, a top view of the actuator 68 is shown, which includes the apertures 216 into which the retaining arms 186, 188 of the housing 66 extend to retain the actuator 68 in place. The generally circular profile of the button 130 of the actuator 68 is also shown, along with the generally outwardly angled profiles of the left and right arms 186, 188 and the front wall 244 and front tab 246. Since the actuator 68 preferably comprises a polymer, the various features of the actuator 68 are configured to flex during assembly of the actuator assembly 64. The angled profiles of the left and right arms 186, 188 allow the actuator 68 to be inserted upward into the interior cavity 194 as the retaining arms 186, 188 are inserted into the apertures 216, during which the left and right arms 210, 212 of the actuator 68 and the left and right retaining arms 186, 188 are capable of flexing.

Figure 21:
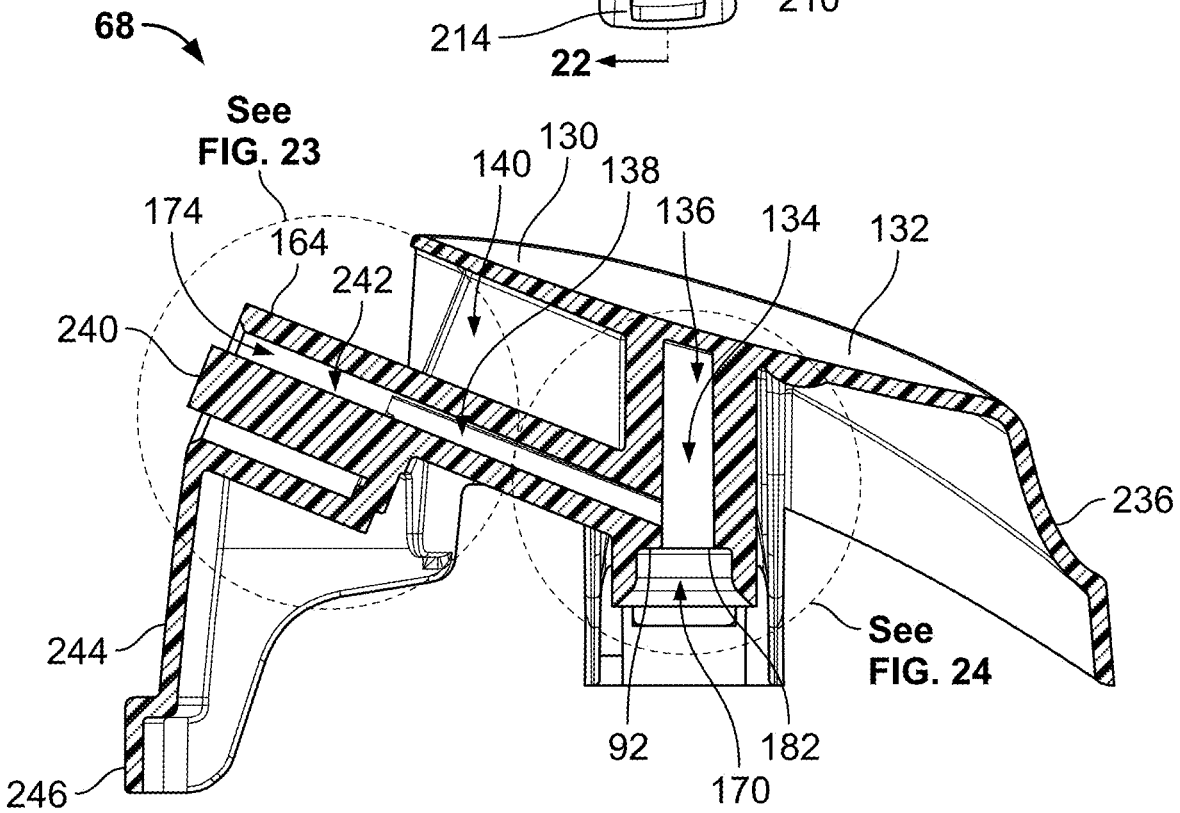
FIG. 21 is a side cross-sectional view of the actuator taken through line 21-21 of FIG. 19.
Figure 22:
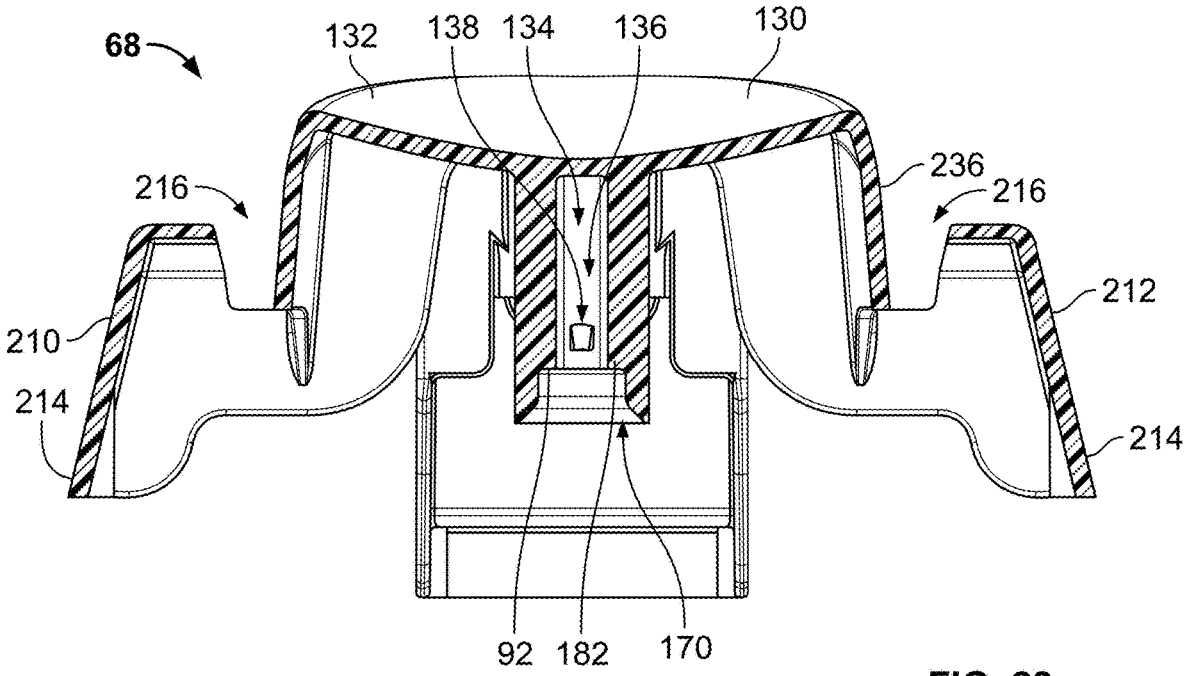
FIG. 22 is a rear cross-sectional view of the actuator taken through line 22-22 of FIG. 20.
Figure 23:
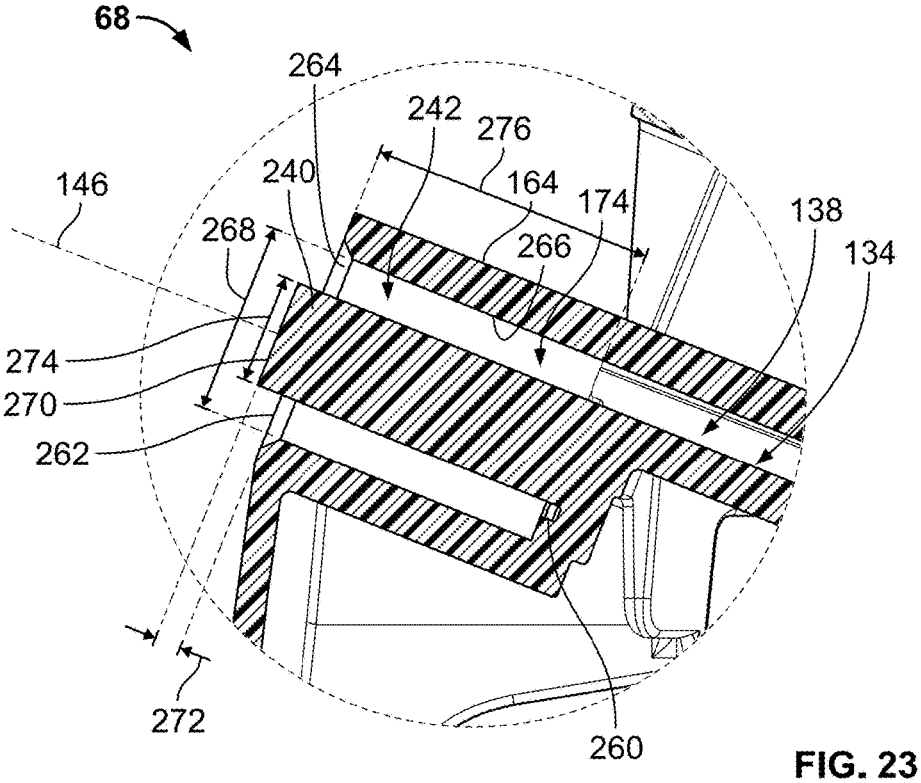
FIG. 23 is a detail cross-sectional view of a nozzle end of the cross-sectional view of the actuator of FIG. 21.

Referring now to FIGS. 21-23, cross-sectional views of the actuator 68 are shown in greater detail. The valve seat 92, the upper surface 182 of the valve seat 92, the fluid passageway 134 including the vertical conduit 136, the angled conduit 138, the nozzle conduit 242, and the top wall 132 are shown in detail. Referring to FIG. 22 in particular, the apertures 216 along left and right sides of the actuator 68, between the left and right arms 210, 212 and the button 130 are shown in greater detail. The nozzle conduit 242 is shown in detail in FIG. 23, and the valve seat 92 is shown in greater detail in FIG. 24.

Referring specifically to FIG. 23, the actuator 68 includes the nozzle conduit 242, which is configured to receive the nozzle insert 70. In the illustrated embodiment, the nozzle-insert conduit 242 defines a generally cylindrical annular cavity that extends generally along the spray axis 146, from a stop portion 260 to an open end 262. Also in the illustrated embodiment, the spray axis 164 is generally centrally located within the post 240 and is arranged at an offset angle with respect to the longitudinal axis 94. Further, the open end 262 includes a chamfered surface 264 that is configured to guide the nozzle insert 70 into the nozzle-insert cavity 174 during assembly. In other embodiments, other configurations are possible. For example, in some embodiments, non-cylindrical or non-symmetrical profiles are possible, as are different (e.g., non-chamfered) configurations at the open end 262. A non-symmetrical profile may be useful, for example in order to allow for use of a wide-angle insert to provide a wide angle spray for foaming cleaners or other products.

For the description herein of features relating to or included within the nozzle-insert cavity 174, the use of the terms "axial," "radial," and "circumferential" (and variations thereof) are based on a reference axis corresponding to the chamber axis 172. In this regard, for example, the nozzle-insert cavity 174 includes a radially outer surface 266 that extends as a generally circumferential barrel around the nozzle-insert cavity 174 and defines an outer diameter 268 thereof. Similarly, the post 240 within the nozzle-insert cavity 174 extends generally axially from a base near the stop portion 260 to a distal end 270 of the post 240 spaced from the open end 262 of the nozzle-insert cavity 174 by a distance 272. The post 240 further defines a post diameter 274, and the insert cavity 174 is further defined by an insert cavity length 276.

In general, the shape and profile defined by the post 240 and by the nozzle-insert cavity 174 are configured to conform generally to one or more portions of the nozzle insert 70, to facilitate receipt and retention of the nozzle insert 70 within the nozzle-insert cavity 174. In the illustrated embodiment, for example, the post 240 and the nozzle-insert cavity 174 define generally cylindrical shapes configured to engage corresponding cylindrical (or other) features on the nozzle insert 70. In other embodiments, for example, the post 240 and/or the nozzle-insert cavity 174 may define different shapes to facilitate receipt and retention of particular nozzle inserts of other shapes and sizes.

Figure 24:
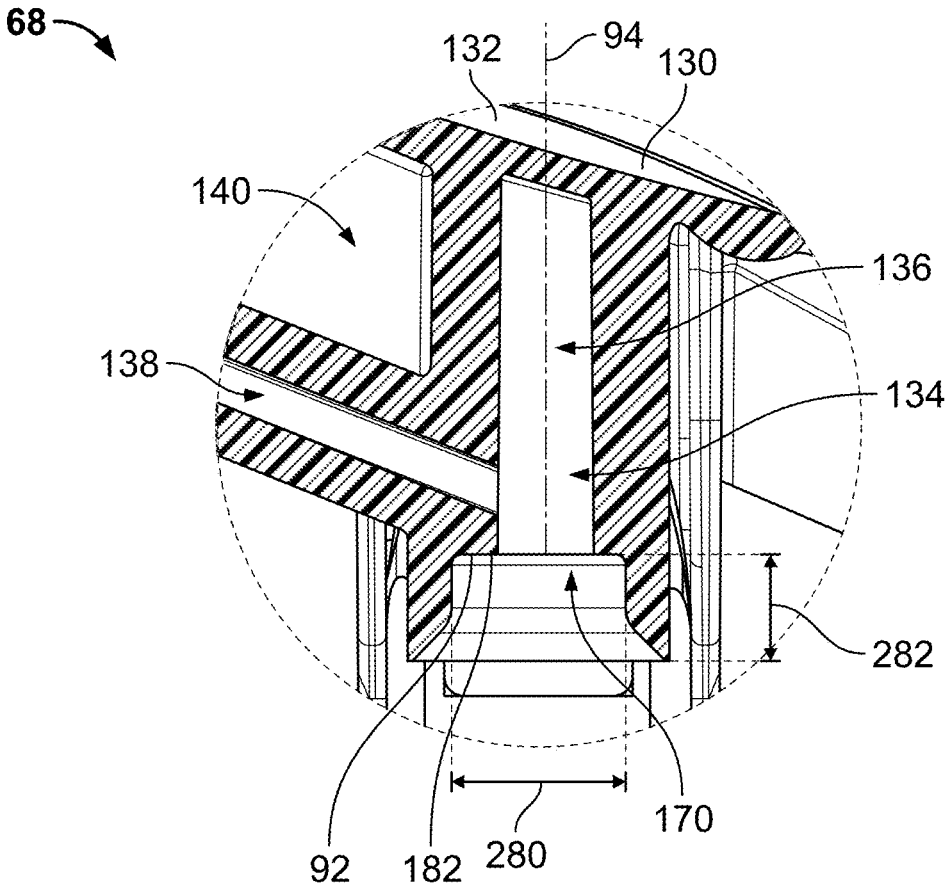
FIG. 24 is a detail cross-sectional view of a valve seat of the cross-sectional view of the actuator of FIG. 21.

Referring to FIG. 24, the vertical conduit 136 defines a generally round bore that extends generally axially along the longitudinal axis 94. In other embodiments, for example, the vertical conduit 136 may define another cross-sectional shape, such as a rectangular, oval, or polygonal shape. The fluid passageway 134 includes the inlet orifice 170 and an outlet in the nozzle conduit 242. The valve seat 92 is configured to slidably receive at least a portion of the valve stem 86 therein. Referring again to FIG. 23, the nozzle conduit 242 is arranged at a second end of the inlet fluid passageway 134, downstream of the valve seat 92, and is configured to provide fluid communication between the inlet orifice 170 and the nozzle conduit 242.

Still referring to FIG. 24, to engage and actuate the valve stem 86, the valve seat 92 defines a generally larger internal diameter 280 than a diameter of the vertical conduit 136. The valve seat also defines a height 282. In operation, for example, the actuator assembly 64 may be manually or automatically displaced to force engagement between the valve stem 86 and a portion of the valve seat 92. As noted above, a user may depress the button 130 to cause the actuator 68 to disengage from the shipping locks 190, 192, which causes the valve seat 92 to be fully seated onto the valve stem 86. With actuation of the actuator assembly 64, the engagement between the valve stem 86 and the portion of the valve seat 92 displaces the valve stem 86 such that the valve assembly opens and allows the product to flow from the container 62 through the valve stem 86 and into the fluid passageway 134.

Referring now to FIGS. 25-29, the nozzle insert 70 is shown in greater detail. The nozzle insert 70 is configured to be inserted at least partially into the nozzle-insert cavity 174 and to thereby promote the dispensing of the product within the container 62 to the surroundings with appropriate fluid flow characteristics. In some embodiments, the nozzle insert 70 may be fabricated from a plastic material. In some embodiments, for example, the nozzle insert 70 may be fabricated from an acetal, i.e., polyoxymethylene, material. In some embodiments, for example, the nozzle insert 70 may be fabricated from polypropylene, propylene, HDPE, nylon, or other co- or homo-polymers.

The nozzle insert 70 includes a nozzle rim 290 and a nozzle body 292 that extends from the nozzle rim 290. The nozzle body 292 defines a generally annular cylinder extending generally axially between the nozzle rim 290 and a generally open insert inlet end 294. The nozzle rim 290 and the nozzle body 292 are connected at a first step 296. The nozzle body 292 defines a front or first portion 298 and a rear or second portion 300 that are separated by a second or chamfered step 302. In other embodiments, for example, the nozzle body 292 may define other shapes, such as rectangular, oval, polygonal, tapered or other shapes, as appropriate. As also discussed below, the inlet end 294 of the nozzle insert 70 can provide access to a nozzle inner cavity 304, to enable the post 240 to be slidably received within the interior cavity 304. The nozzle rim 290 further defines a nozzle front wall or rim wall 306, which defines the nozzle orifice 176.

Figure 27:
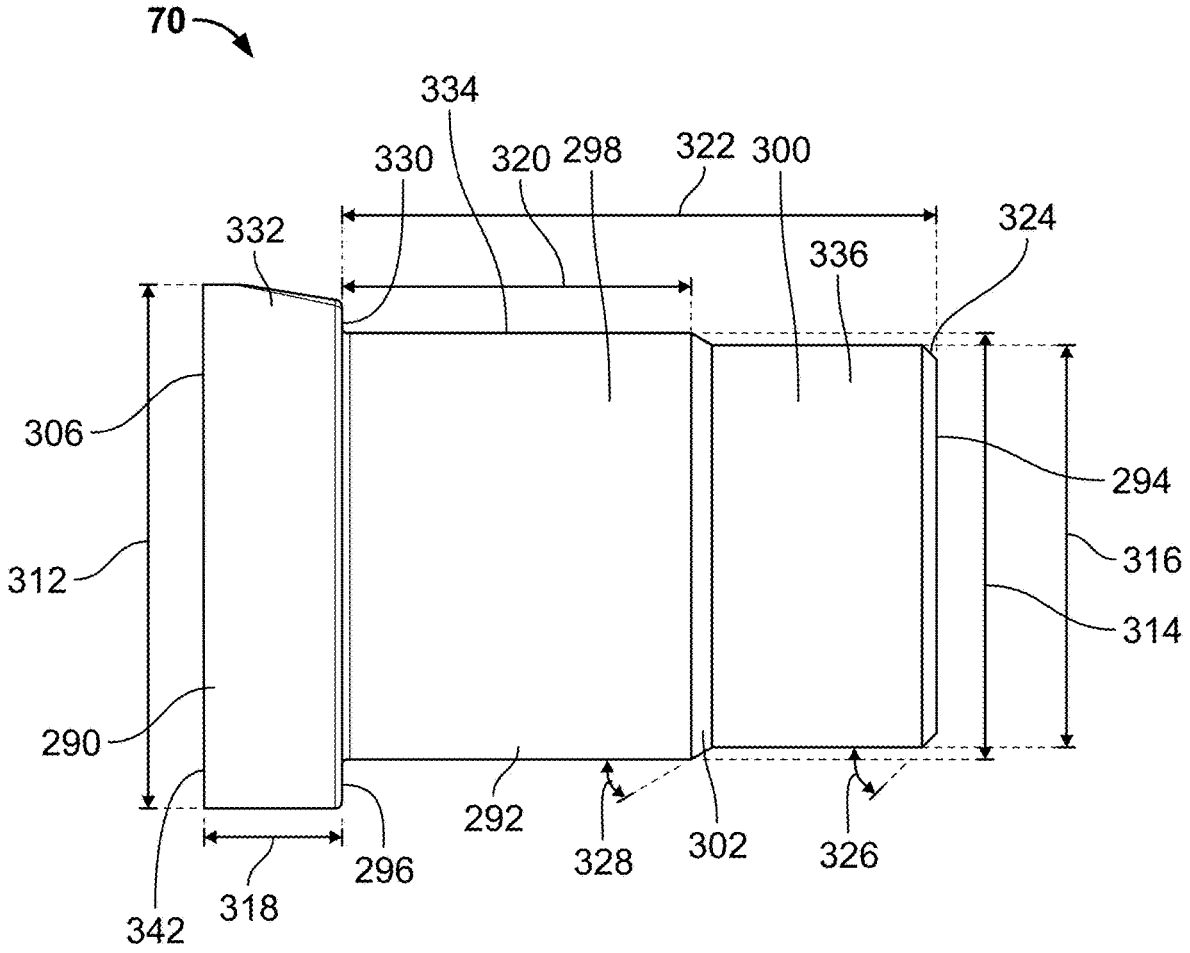
FIG. 27 is a side elevational view of the nozzle insert of FIG. 25.
Figure 28:
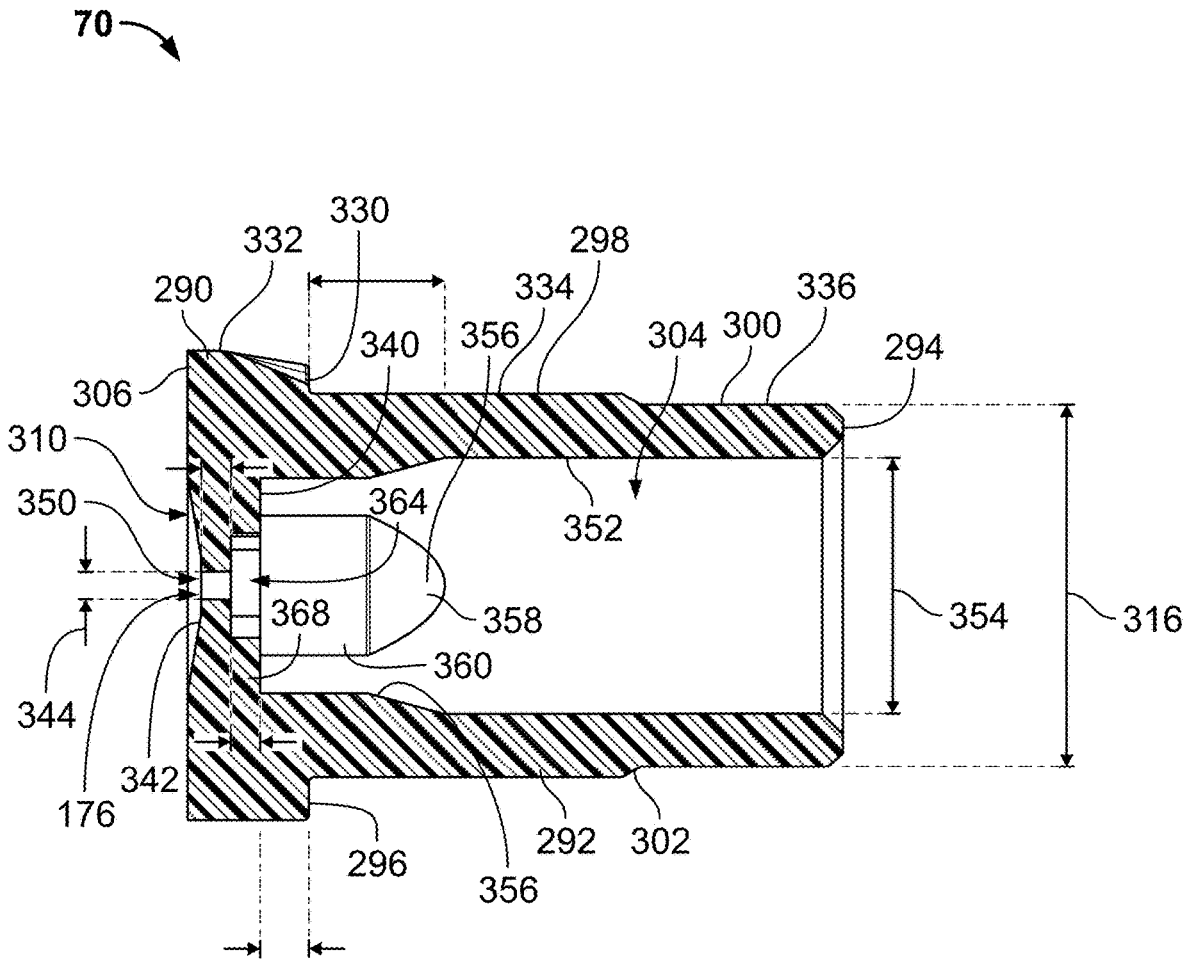
FIG. 28 is a side cross-sectional view of the nozzle insert taken through line 28-28 of FIG. 26.

Referring to FIG. 27, the nozzle body 292 defines the rear portion 300 and the front portion 298, which are separated from one another by the chamfered step 302. A depression 310 is disposed within a portion of the nozzle rim 290, and the outlet orifice 176 is disposed within front wall 306 of the nozzle insert 70. Referring in particular to FIGS. 27 and 28, the nozzle insert 70 defines a rim diameter 312, a first portion diameter 314, and a second portion diameter 316, wherein the rim diameter 312 is larger than a front portion diameter 314, and the front portion diameter 314 is larger than a rear portion diameter 316. Still further, the rim 290 defines a rim depth 318, the front portion 298 defines a front portion depth 320, and the nozzle body 292 defines a body depth 322. Still further, a rear chamfered edge 324 of the nozzle insert 70 defines a first chamfered angle 326, and the chamfered step 302 defines a second chamfered angle 328. In other embodiments, other configurations are possible.

In general, the stepped profile of the nozzle body 292 is designed to interact with the nozzle conduit 242 of the actuator 68 to provide engagement and to impede over-insertion of the nozzle body 292 into the nozzle-insert cavity 174. In the illustrated embodiment, for example, the nozzle rim 290 of the nozzle insert 70 includes a stepped configuration defining a first insert stop surface 330, which defines a radially-extending surface. The first insert stop surface 330 extends generally radially inward between a rim outer surface 332, which defines the rim diameter 312, and a front portion surface 334, which defines the front portion diameter 314. The rear portion 300 also defines a rear portion surface 336, which is further stepped inward via the chamfered step 302.

Figure 25:
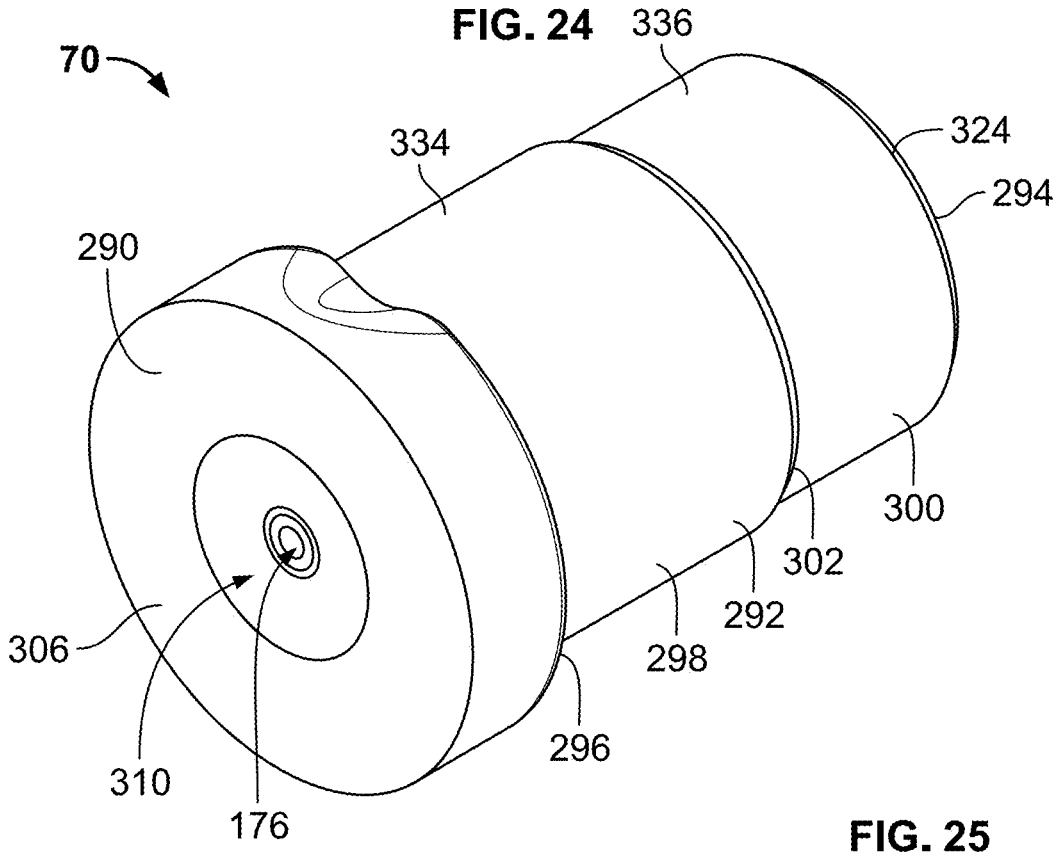
FIG. 25 is a front isometric view of a nozzle insert of the actuator assembly of FIG. 1.
Figure 26:
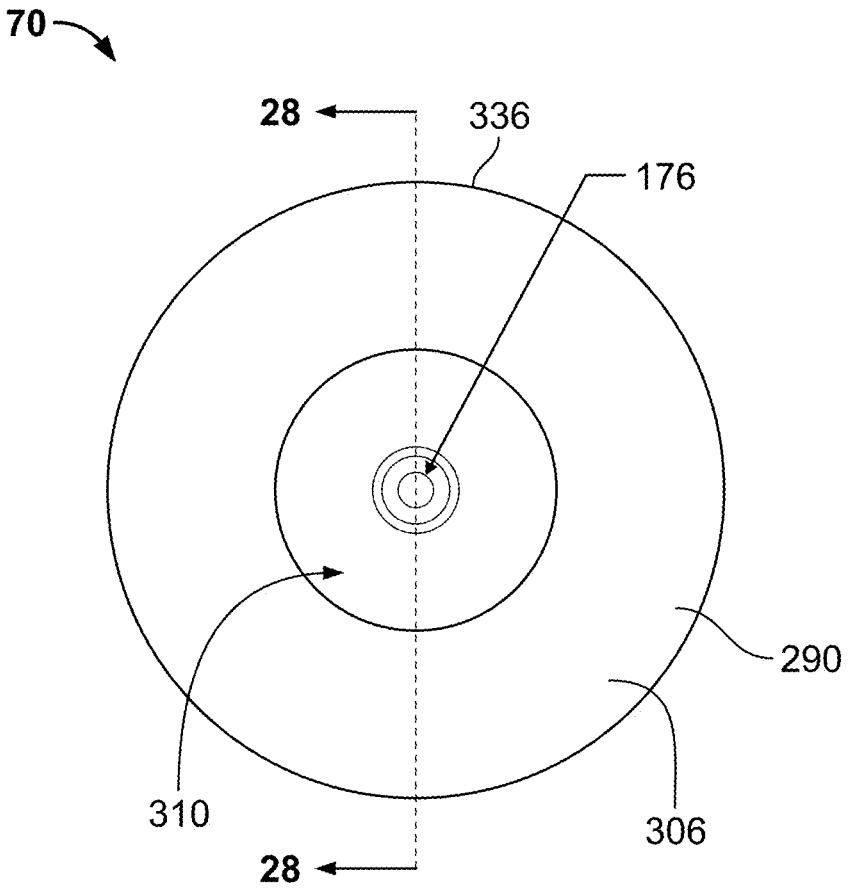
FIG. 26 is a front elevational view of the nozzle insert of FIG. 25.

As illustrated in FIGS. 25 and 26, the rim wall 306 includes the nozzle orifice 176, which extends therethrough to provide fluid communication between the inner cavity 304 of the nozzle insert 70 and the atmosphere. Referring to FIG. 28, the orifice 176 extends through the rim wall 306 from a radially extending inner rim surface 340 to a radially extending outer rim surface 342. In some embodiments, for example, an orifice diameter 344 or other aspect of the orifice 176 may be designed to achieve a desired flow pattern and/or atomization of the fluid flowing therethrough. For example, as described below, varying the orifice diameter 344 provides for different effects or impacts, which benefit the nozzle insert 70 used with the actuator assembly 64. In the illustrated embodiment, the orifice 176 is arranged along the spray axis 146 defined by the nozzle insert 70. In some embodiments, for example, the orifice 176 may be eccentrically arranged on the insert outlet end to provide a desired flow pattern and/or atomization of the fluid flow therethrough. In some embodiments, multiple outlet orifices may be provided.

As illustrated in FIG. 28, the outer rim surface 342 defines the depression or recessed portion 310 arranged generally concentrically with the orifice 176. The recessed portion 310 defines a generally frustoconical recess in the outer rim surface 342 that decreases in diameter (with respect to the spray axis 146) as the recesses extends axially toward the inner rim surface 340. The recessed portion 310 extends axially from the rim wall 306 to an outlet 350 of the orifice 176 at a location between the outer rim surface 342 and the inner rim surface 340. In other embodiments, for example, the outer rim surface 342 may define a generally flat profile without a recessed portion, or a profile with a protruding portion, or may include multiple recessed or protruding portions or a recessed portion with a different profile than illustrated. Similarly, in other embodiments, a nozzle assembly can exhibit other configurations to impart desired flow characteristics to a product stream. For example, in some embodiments, an actuator can include various grooves or channels that lead to an outlet swirl chamber, from which fluid can pass to the orifice 176 to be dispersed, as discussed below.

Still referring to FIG. 28, in particular, a radially inner surface 352 of the nozzle body 292, which partially defines the interior cavity 304 of the nozzle body 292, defines an inner diameter 354 that is generally constant along the interior cavity 194, between the inner rim surface 340 and the insert inlet end 294. In the illustrated embodiment, a plurality of ribs 356 extend generally radially inward from the inner surface 352 of the nozzle body 292, resulting in local deviations from the diameter 354 along the ribs 356. In the embodiment illustrated, the nozzle insert 70 includes four ribs 356 arranged circumferentially around the interior surface 352 in approximately 90 degree increments. In other embodiments, for example, the nozzle insert 70 may include more or fewer ribs, or may include flats, any of which may be arranged circumferentially around the interior surface 352 in any increment, as desired.

In the illustrated embodiment, each of the plurality of ribs 356 includes a ramp portion 358 and a spacer portion 360. Each of the plurality of ribs 356 extend axially along the interior surface 160 from between the insert inlet end 294 and the inner rim surface 340. Moving in a direction from the insert inlet end 294 toward the rim wall 306, i.e., opposite to the insertion direction, each of the plurality of ribs 356 begins at the ramp portion 358. At the junction between the ramp portion 358 and the spacer portion 360, the radially inward taper of the ramp portion 358 discontinues and the spacer portion 360 extends in the axial direction to the inner rim surface 340 with a generally constant radial thickness. As also discussed below, the ribs 356 are configured to engage the post 240 of the nozzle-insert cavity 174 to center, or otherwise align, and secure the nozzle insert 70 within the nozzle-insert cavity 174.

Figure 29:
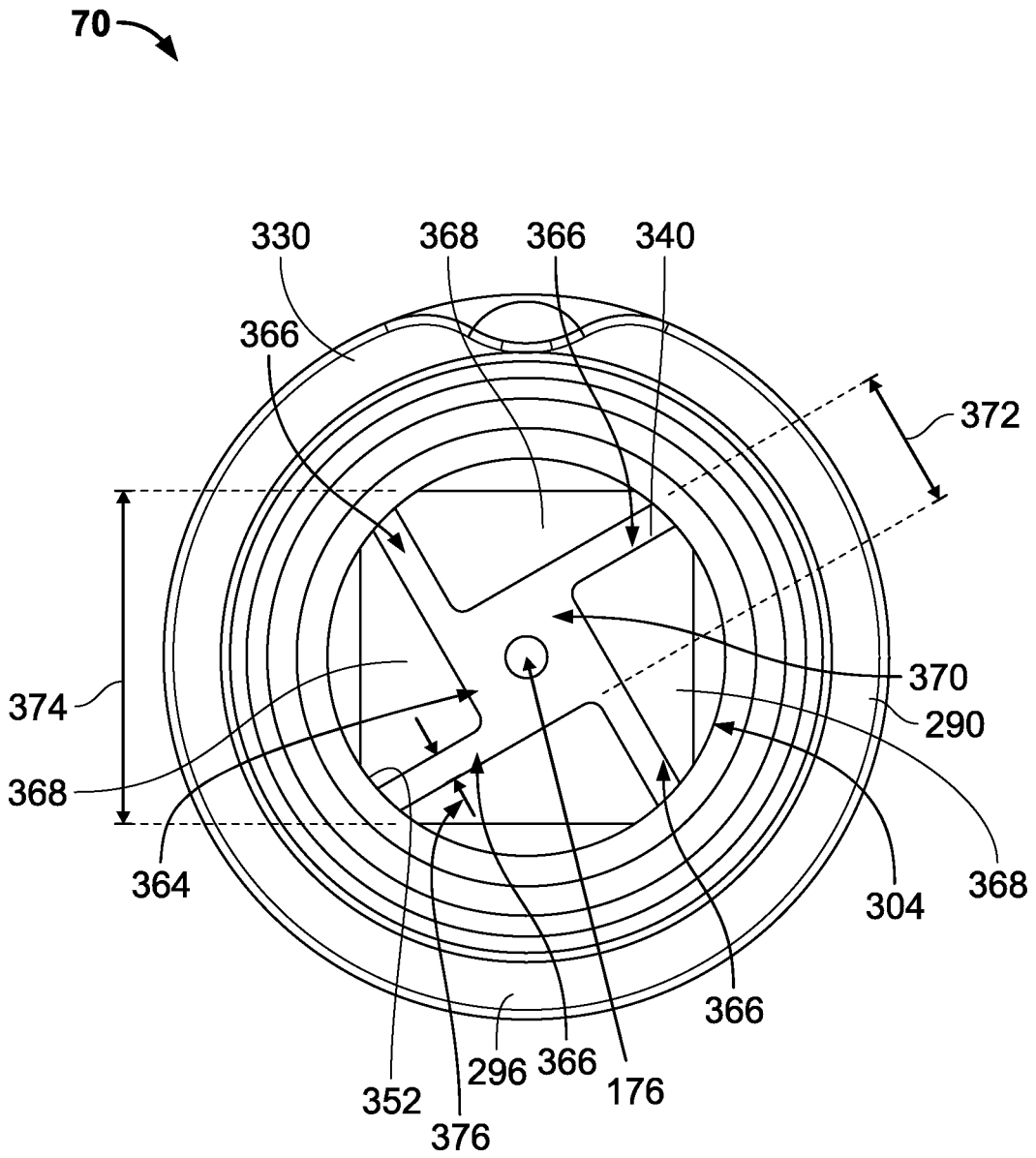
FIG. 29 is a rear elevational view of the nozzle insert of FIG. 25.

Referring to FIGS. 28 and 29, the inner rim surface 340 of the insert 70 defines a central recess 364 and a plurality of radially-extending channels 366 that are disposed between four radially-disposed swirl features 368, which extend from, and are integral with the rim wall 306. The central recess 364 operates as a swirl chamber, which, in combination with the channels 366, operates to create a swirl of the composition centrally, at a location of the orifice 176. In the illustrated embodiment, a distribution chamber 370 of the nozzle insert defines a channel distance 372 between parallel channels 366 and a height 374 between ribs 356. In some embodiments, the height 374 between ribs 356 may be designed such that fluid flow may be appropriately distributed around the post 240 and within the nozzle insert 70, in order to provide a desired swirl (or other) flow pattern. The channels also define a channel thickness 376.

Referring to FIG. 28, a cross-sectional view of the nozzle insert 70 is shown in detail. During assembly, the post 240 of the actuator 68 is received within the interior cavity 304 of the nozzle insert 70. The post 240 engages one or more of the plurality of ribs 356 on an interior surface 160 of the nozzle insert 70. Due to the taper of the ramp portions 358, the plurality of ribs 356 are configured to guide the post 240 to a desired alignment within the interior cavity 304 (or, correspondingly, to guide the nozzle insert 70 into appropriate alignment with the post 240 and the nozzle-insert cavity 174). Once the post 240 passes over the junction between the ramp portions 358 and the spacer portions 360, the spacer portions 360 act to set the alignment of the post 240 within the interior cavity 194 and correspondingly, to set the alignment of the nozzle insert 70 with the post 240 and the nozzle-insert cavity 174. In the embodiment illustrated, the nozzle insert 70 is aligned generally coaxially with the nozzle-insert cavity 174 after assembly. In some embodiments, the nozzle insert 70 may be otherwise aligned with the nozzle-insert cavity 174 (e.g., disposed eccentrically within the nozzle-insert cavity 174) after assembly.

In other embodiments, other configurations are possible. For example, channels for flow of product to one or more outlet orifices of a nozzle insert can be formed on a distal end of a post similar to the post 240, or on other similar features, instead of or in addition to being formed on an inner wall of the nozzle insert, such as the rim wall 306. In some embodiments, certain flow paths for product can be defined by raised or otherwise protruding features, rather than recessed channels. In some embodiments, an outlet swirl chamber can have a different geometric shape than the swirl chamber, such as a circular or other shape, and flow channels leading to an outlet swirl chamber, such as the channels 366, can define curved or other flow paths. In some embodiments, an outlet swirl chamber can have stepped or curved walls leading to one or more outlet orifices.

Figure 30:
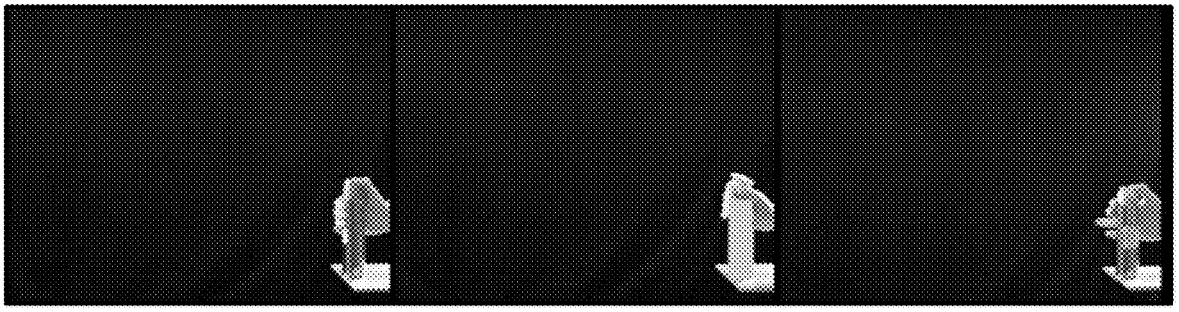
FIG. 30 is a first image in a sequence comparing spray dispersion patterns of the dispensing system of FIG. 1 and prior art dispensing systems.
Figure 31:
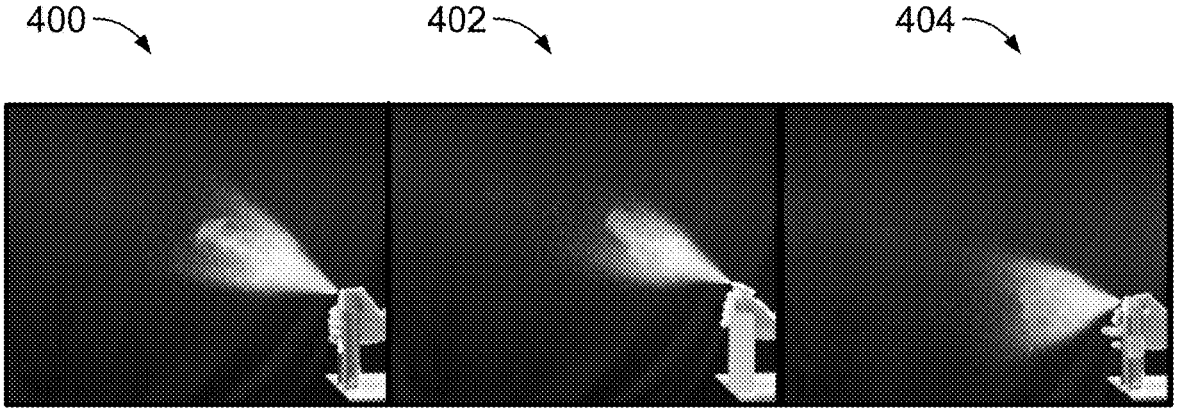
FIG. 31 is a second image in the sequence comparing spray dispersion patterns of the dispensing system of FIG. 1 and prior art dispensing systems.
Figure 32:
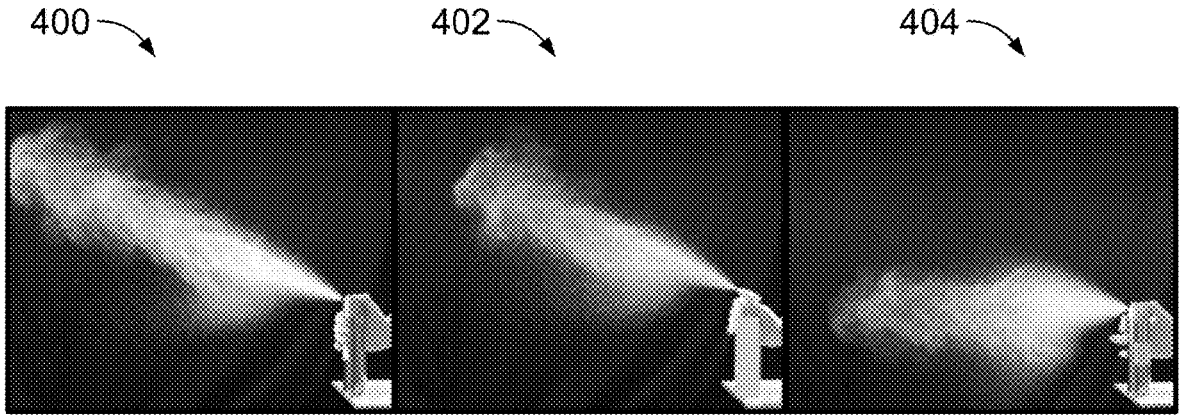
FIG. 32 is a third image in the sequence comparing spray dispersion patterns of the dispensing system of FIG. 1 and prior art dispensing systems.

Now referring to FIGS. 30-39, the benefits of the dispensing system 60 as disclosed herein will be discussed. Referring specifically to FIG. 30, a first image is shown of a sequence comparing spray dispersion patterns of the dispensing system of FIG. 1 and prior art dispensing systems, FIG. 31 is a second image of the sequence, and FIG. 32 is a third image of the sequence. FIG. 30 illustrates a null state, i.e., before the actuating systems of the various dispensing systems have been actuated. FIG. 31 illustrates a first state, which illustrates a first spray pattern 400, a second spray pattern 402, and a third spray pattern 404. The first spray pattern 400 is reflective of a spray pattern produced by the dispensing system 60 disclosed herein, while the second spray pattern 402 and the third spray pattern 404 illustrate spray patterns of prior art sprays. The spray patterns 400, 402, 406 are further shown in a second state in FIG. 32, which occurs after the first state.

The images in the sequence of FIGS. 30-32 are taken at identical times in the spraying process; thus, the spray patterns 400, 402, 406 depict the various sprays at the same points in time after an initial actuation of the various actuators of the product dispensing systems. As shown in the figures, the first spray pattern 400 and the second spray pattern 402 both dispense spray at an angle above the horizontal (the product dispensing system 60 sprays at an angle of about 22° above the horizontal or 68° from the vertical), while the third spray pattern 404 dispenses spray in a direction that is generally perpendicular with respect to the horizontal. To achieve a preferred fallout, it has been determined that having an angle of above 0 degrees from the horizontal is beneficial, as noted above with respect to the various preferred ranges. Still further, as shown in FIG. 32, in the second state, the first spray pattern 400 includes droplets that have been dispensed relatively farther than droplets of the second spray pattern 402. The increased distance is due, at least in part, to the use of the compressed gas, modified composition, and increased pressure within the container 62, as disclosed herein. The increased throw distance of the dispenser 60 provides for reduced fallout, as shown in the graphs and tables provided below.

Referring to Table 1 below, various aerosol sprays were simulated in a six foot by nine foot (6'×9') bathroom to determine perceptible fragrance coverage after 10 minutes. The simulation was conducted using a full and a 25% full can of the aerosol fragrance. Therefore, the two simulations test the perceptible fragrance coverage at the beginning and end of life of each of the aerosol cans. As illustrated in Table 1 below, the dispensing system 60 aerosol outperformed the other prior art aerosols in perceptible fragrance coverage for both the full can and 25% full can. In particular, after 10 minutes, the dispensing system 60 aerosol filled approximately 96% of the bathroom when a full can was used and approximately 92% of the bathroom when a 25% full can was used. Therefore, the dispensing system 60 aerosol has a better fragrance reach than the prior art aerosols.

TABLE 1

| Aerosol | Perceptible Fragrance Coverage at Full Can | Perceptible Fragrance Coverage at 25% Full - End of Life |
|---|---|---|
| Dispensing system 60 | 96% | 92% |
| Glade ® 2 | 79% | 82% |
| Glade ® 1 | 80% | 72% |
| Febreze ® | 87% | 72% |

Figure 33:
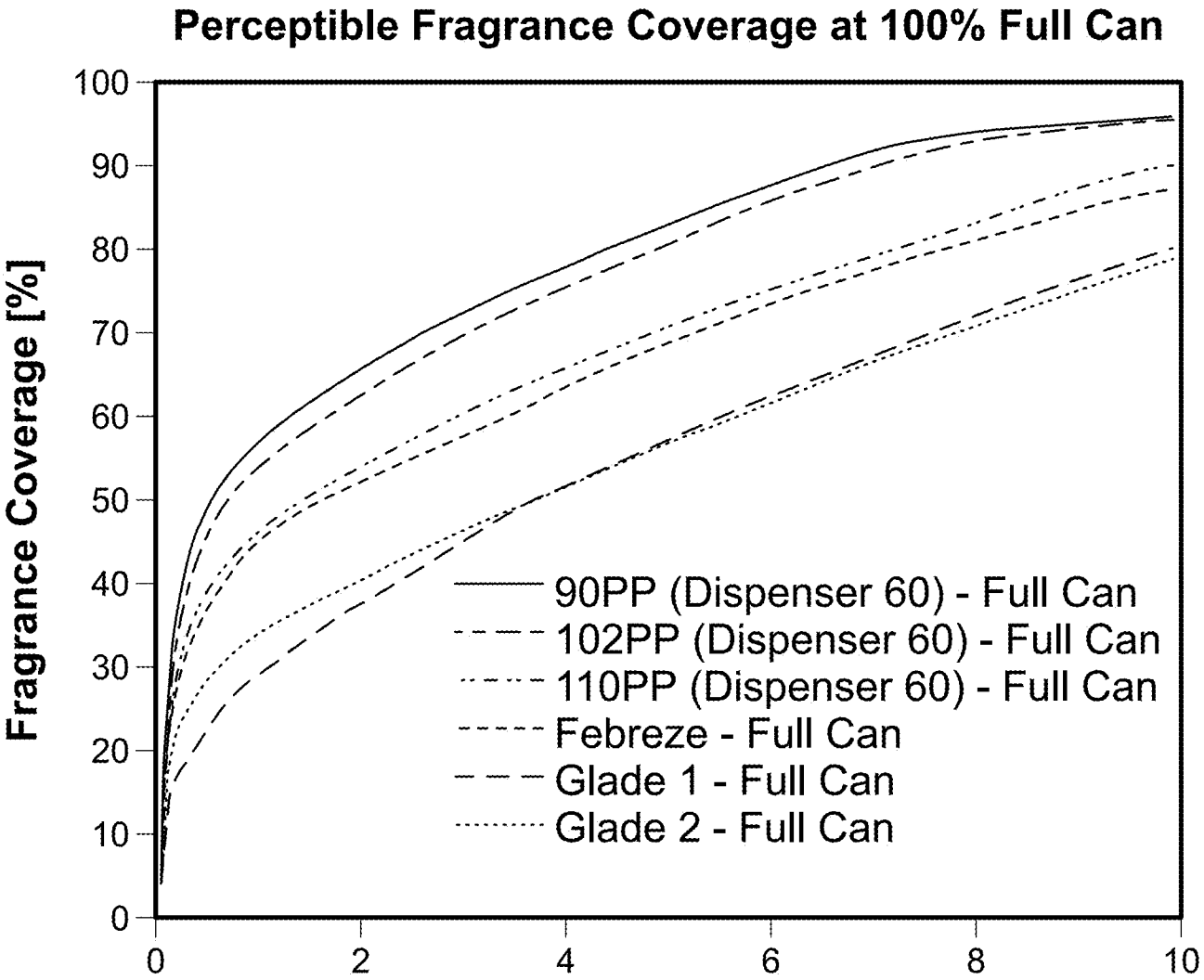
FIG. 33 is a graph illustrating a comparison of the perceptible fragrance coverage at 100% full for the dispensing system of FIG. 1 and prior art dispensing systems.

FIG. 33 is a graph illustrating a comparison of the perceptible fragrance coverage at 100% full for the dispensing system 60 of FIG. 1 using nozzle inserts 70 having varying orifice diameters 344, as well as prior art dispensing systems. The data reflective of the 90PP, 102PP, and 110PP illustrates better fragrance coverage over time than Febreze®, Glade® 1, and Glade® 2. 90PP, 102PP, and 110PP include the dispensing system 60 with the only difference being the use of nozzle inserts 70 having varying orifice diameters. The 90PP dispenser included the smallest orifice diameter 344, while the 110PP dispenser included the largest orifice diameter 344. As illustrated in FIG. 33, the orifice diameter 344 of the nozzle insert 70 is helpful to increase fragrance coverage. Further, all three of the data shown for the product dispensing system 60 provide for increased fragrance coverage when compared against the prior art dispensing systems. To that end, it has been determined that the nozzle insert 70 disclosed herein is beneficial to provide for increased fragrance coverage, and thereby reduce fallout, in combination with other aspects of the product dispensing system 60 disclosed herein, and more specifically, the particular spray orifice diameter 344 has been found to provide increased coverage and reduce fallout. The spray orifice diameter 344 may between about 0.310 mm and about 0.410 mm, or between about 0.335 mm and about 0.385 mm, or between about 0.350 mm and about 0.370 mm, or about 0.360 mm.

Figure 34:
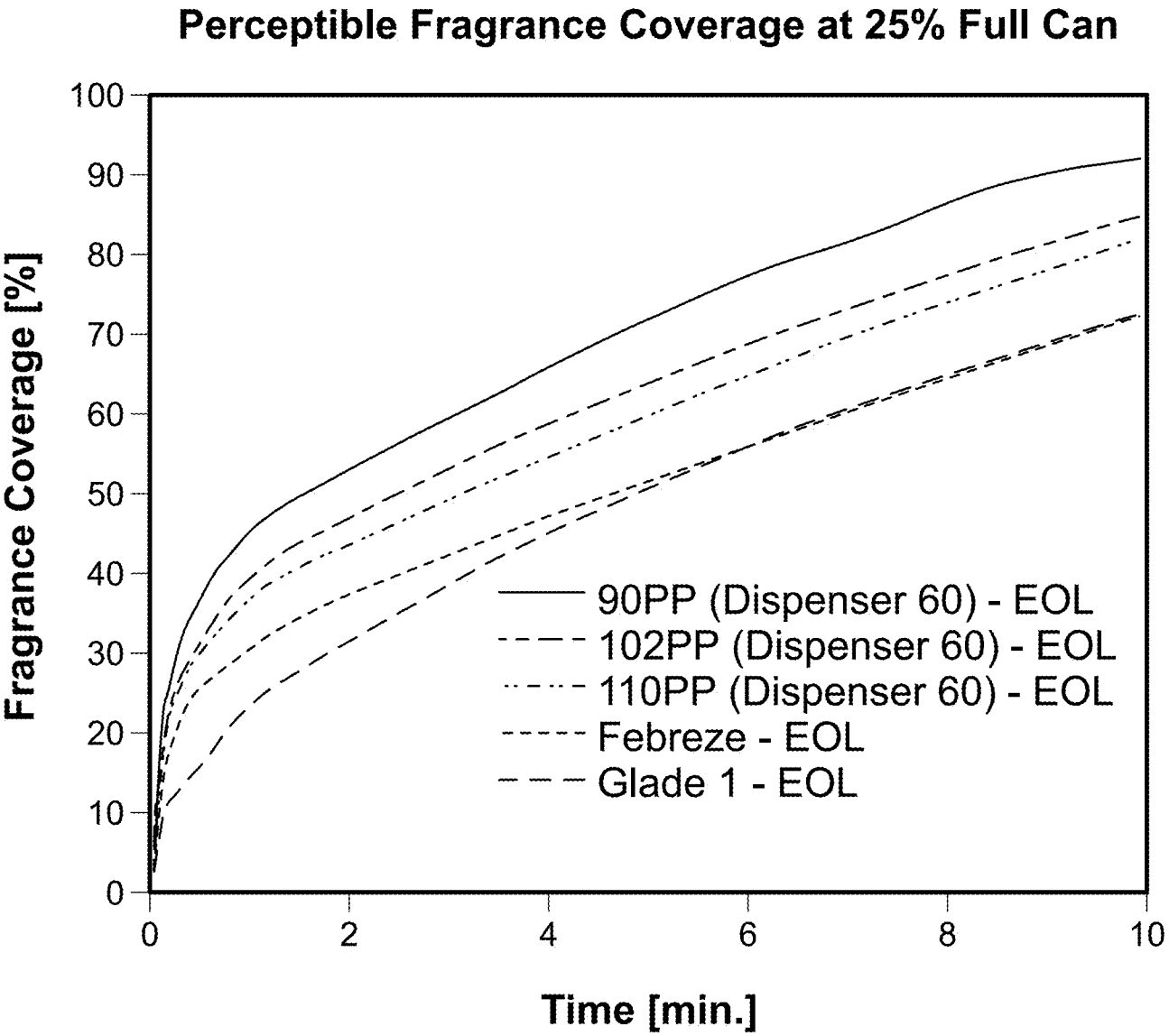
FIG. 34 is a graph illustrating a comparison of the perceptible fragrance coverage at 25% full for the dispensing system of FIG. 1 and prior art dispensing systems.

FIG. 34 is another graph illustrating a comparison of the perceptible fragrance coverage, but at 25% full for the dispensing system 60 and prior art dispensing systems. The graph of FIG. 34 illustrates data reflective of the same dispensing systems as FIG. 33, without the addition of the Glade® 2 dispensing system. As with FIG. 33 illustrating the fragrance coverage of dispensing systems beginning will full containers, the data of FIG. 34 that is reflective of the 90PP, 102PP, and 110PP illustrates better fragrance coverage over time than Febreze® and Glade® 1. 90PP, 102PP, and 110PP include the dispensing system 60 with the only difference being the use of nozzle inserts 70 having varying orifice diameters. The 90PP dispenser included the smallest orifice diameter 344, while the 110PP dispenser included the largest orifice diameter 344. As illustrated in FIG. 34, the orifice diameter 344 of the nozzle insert 70 is helpful to increase fragrance coverage. Further, all three of the data shown for the product dispensing system 60 provide for increased fragrance coverage when compared against the prior art dispensing systems. To that end, it has been determined that the nozzle insert 70 disclosed herein is beneficial to provide for increased fragrance coverage, and thereby reduce fallout, in combination with other aspects of the product dispensing system 60 disclosed herein, even when less product exists within the container, i.e., when approaching an end of life (EOL) of the product dispensing system.

Figure 35:
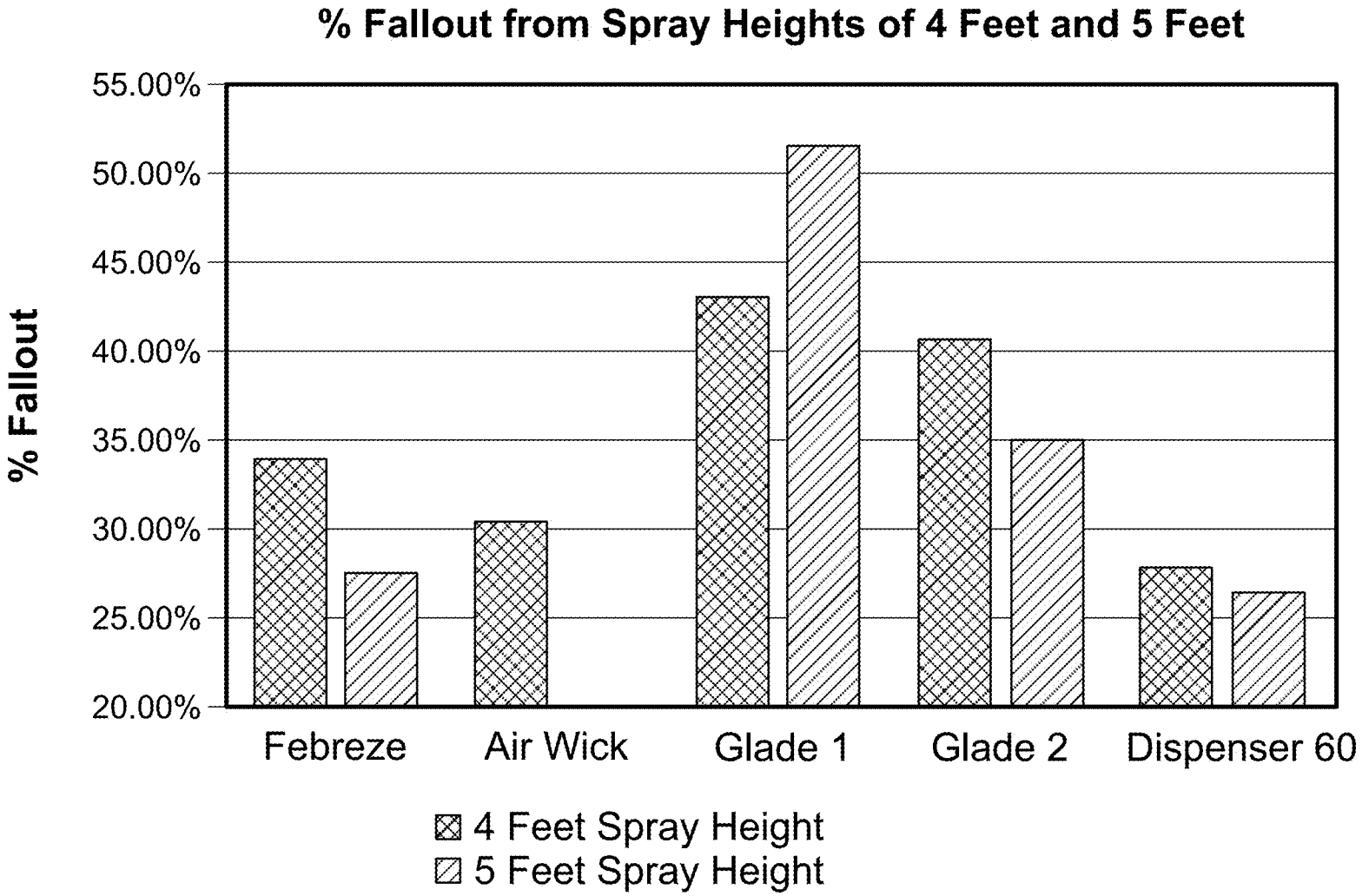
FIG. 35 is a graph illustrating a comparison of the percent fallout from various spray heights for the dispensing system of FIG. 1 and prior art dispensing systems.

FIG. 35 is a graph illustrating a comparison of the percent fallout from various spray heights for the dispensing system of FIG. 1 and prior art dispensing systems. The data of FIG. 35 is further shown in Tables 2 and 3 below, which illustrate experimental results from a percent (%) fallout test conducted with the dispensing system 60 illustrated in FIG. 1 and various prior art dispensing systems at two different heights, i.e., 4 feet (122 cm) and 5 feet (152 cm).

TABLE 2

| Product (n = 3) | Spray Height (ft) | Spray Duration (s) | % Fallout |
|---|---|---|---|
| Febreze ® | 4 | 5 | 33.90% |
| Air Wick ® | 4 | 5 | 30.51% |
| Glade ® 1 | 4 | 5 | 43.12% |
| Glade ® 2s | 4 | 5 | 40.78% |
| Dispensing system 60 | 4 | 5 | 28.00% |

TABLE 3

| Product (n = 3) | Spray Height (ft) | Spray Duration (s) | % Fallout |
|---|---|---|---|
| Febreze ® | 5 | 5 | 27.55% |
| Air Wick ® | 5 | 5 | NA |
| Glade ® 1 | 5 | 5 | 51.62% |
| Glade ® 2s | 5 | 5 | 34.88% |
| Dispensing system 60 | 5 | 5 | 26.48% |

As noted herein, the % Fallout test measures the amount of aerosol liquid that falls to the ground after it has been sprayed in the air. In order to conduct this test, a three by six (3×6) array of scales were placed on a ground surface and a substrate was placed over the scales to define a spray surface. Before each product was tested, the product was weighed to determine an initial weight (Wi). The product was then sprayed at a particular height, i.e., 4 feet or 5 feet, for 5 seconds in a direction of the substrate and scales. After the aerosol spray had settled, the weight of the liquid, or fallout, on the substrate (Ws) was recorded and the product was weighted again to determine a final weight (Wf). Using the difference between the initial weight (Wi) and the final weight (Wf) and the weight of the liquid on the substrate (Ws), a % Fallout was determined (see equation below). After the % Fallout was determined, the substrate was replaced, and the test was repeated three times for each product at each height. The % Fallout data shown in Tables 2 and 3 above is the average of the three tests performed for each product at each height.

$$\% \text{ Fallout} = \frac{W_s}{W_i - W_f} * 100$$

As illustrated in Tables 2 and 3 above, the dispensing system 60 produced the least amount of % Fallout versus the other prior art products. In some instances, the % Fallout for the Dispensing system 60 assembly was almost half of the prior art examples. Therefore, the dispensing system 60 shown in FIG. 1 allows a higher percentage of aerosol fragrance to remain suspended within the air rather than falling to the ground. As such, a consumer can spray less product to produce the desired intensity of the fragrance, thereby increasing the life span of the product. In some embodiments, the % fallout for the dispensing system 60 at 4 feet (122 cm) may be between about 10% and about 50%, or between about 15% and about 40%, or between about 23% and about 36%, or about 28%, or at least 10%, or at least 15%, or at least 23%, or at least 28%. Further, the % fallout for the dispensing system 60 at 5 feet (152 cm) may be between about 10% and about 50%, or between about 15% and about 40%, or between about 22% and about 33%, or about 26%, or at least 10%, or at least 15%, or at least 22%, or at least 26%.

Figure 36:
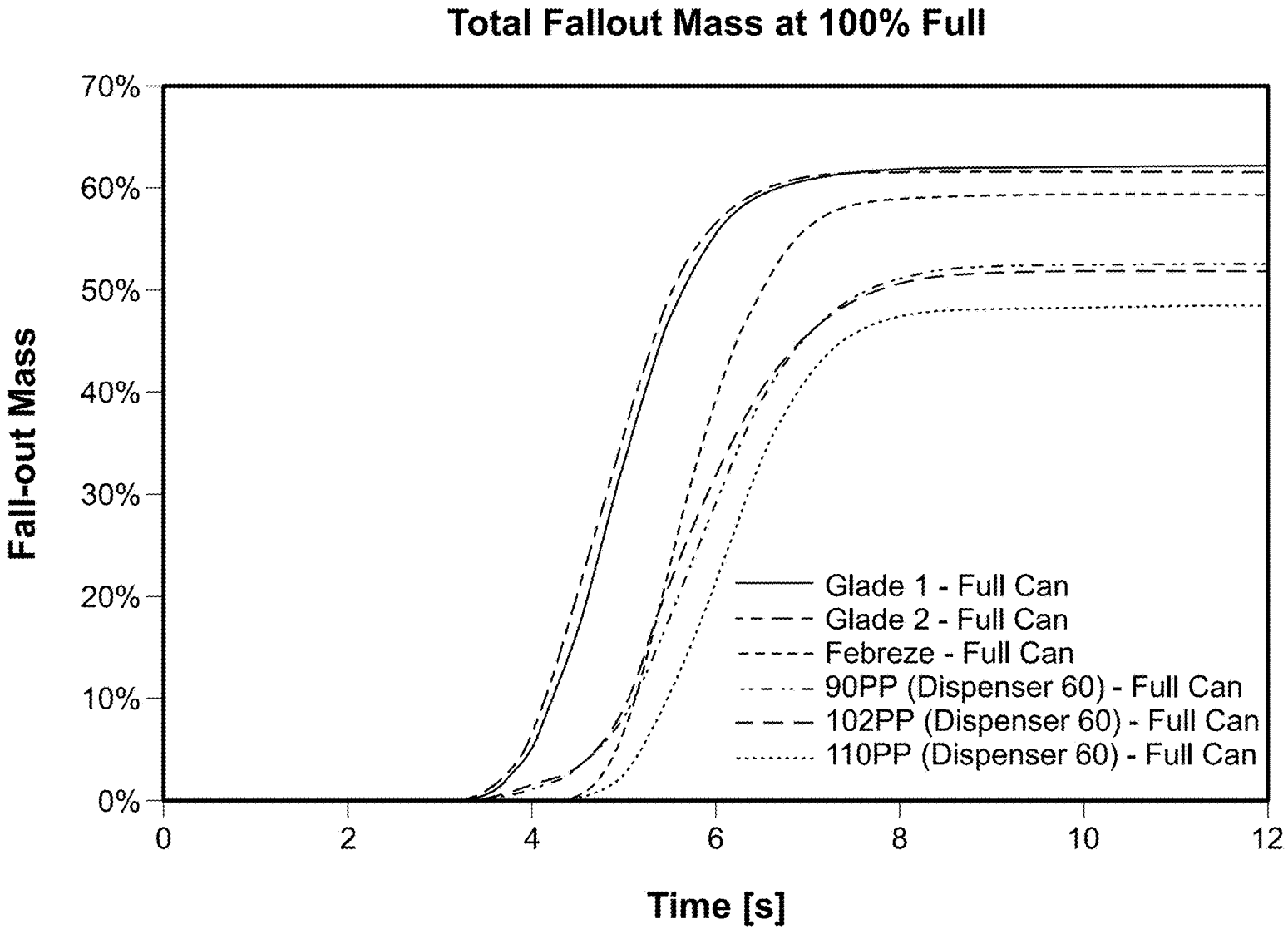
FIG. 36 is a graph illustrating a comparison of the total fallout mass at 100% full for the dispensing system of FIG. 1 and prior art dispensing systems.
Figure 37:
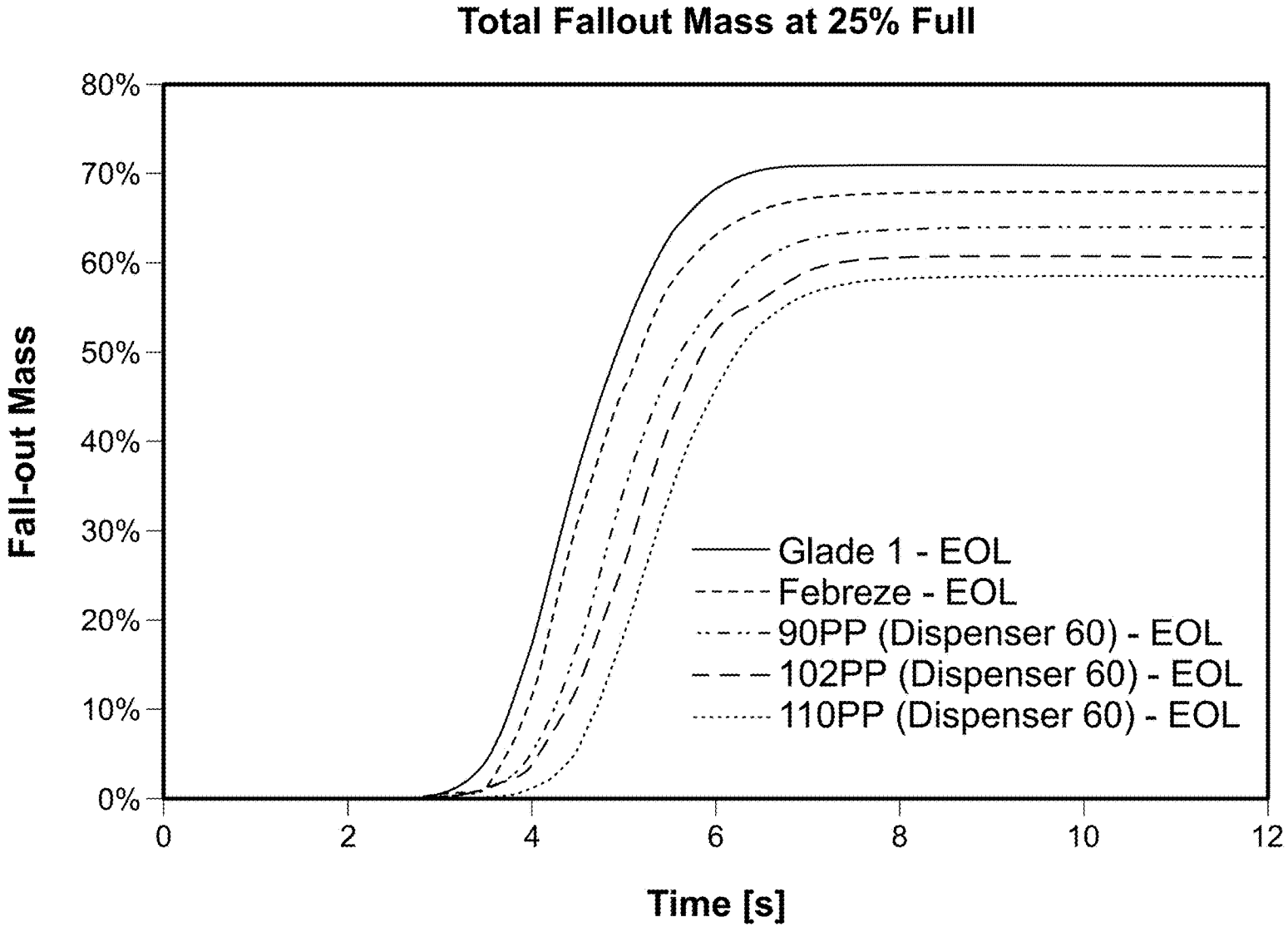
FIG. 37 is a graph illustrating a comparison of the total fallout mass at 25% full for the dispensing system of FIG. 1 and prior art dispensing systems.

Now referring to FIGS. 36 and 37, graphs illustrating comparisons of the total fallout mass at 100% full and 25% full, respectively, for the dispensing system of FIG. 1 and prior art dispensing systems are shown. The graphs of FIGS. 36 and 37 illustrate simulations of the fallout mass, i.e., the mass of fallout that results during spraying of the various dispensing systems after each of the dispensing systems has been actuated for ten minutes. The graphs of FIGS. 36 and 37 provide further data to demonstrate that the dispensing system 60 achieves reduced fallout when tested in identical conditions against prior art dispensing systems. Still further, while different versions of the nozzle insert 70 having different orifice diameters 344 were utilized, all three of the nozzle inserts 70 performed better than the prior art, and created reduced fallout.

Figure 38:
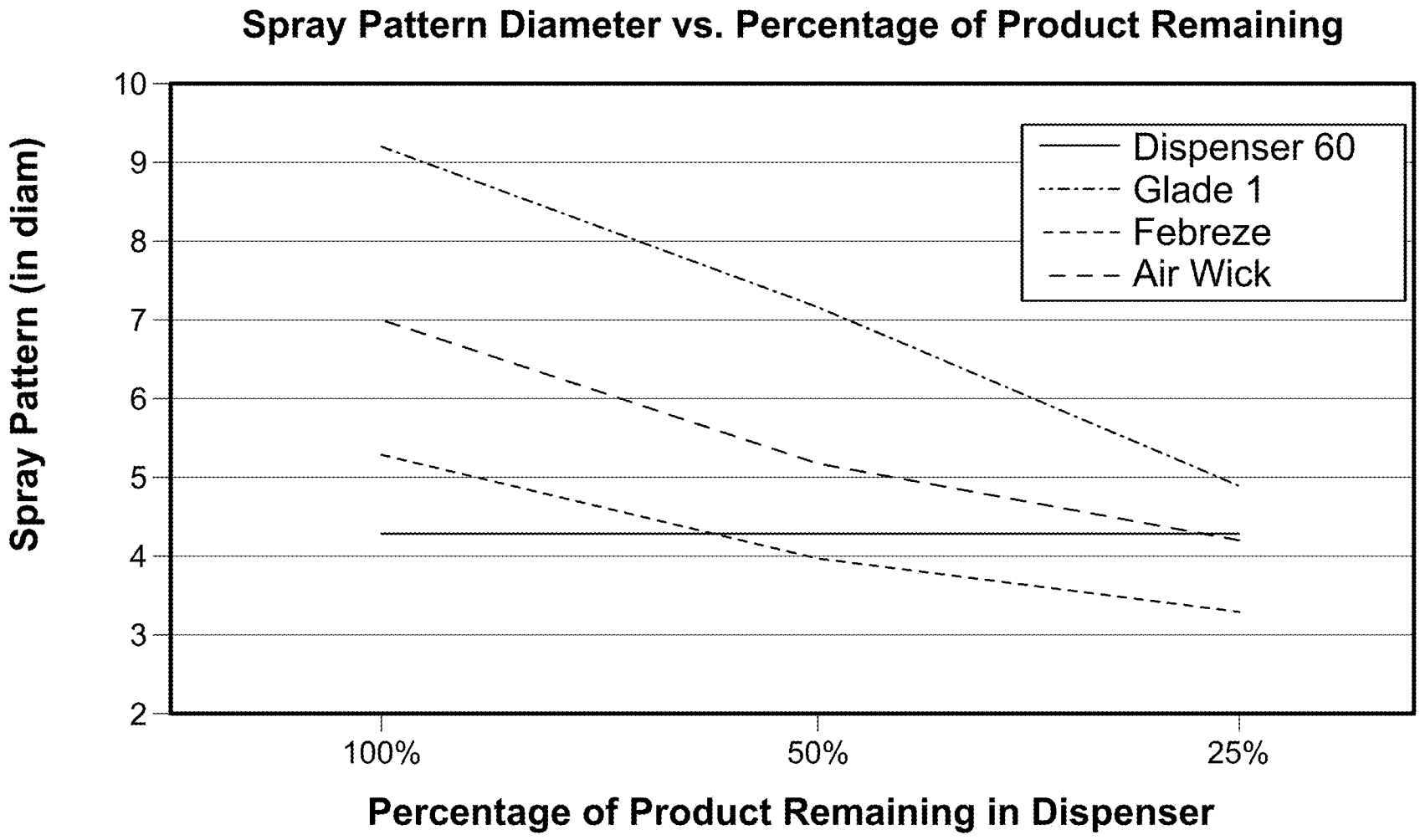
FIG. 38 is a graph illustrating a comparison of the average spray pattern diameters compared against percentage of product remaining in the container for the dispensing system of FIG. 1 and prior art dispensing systems.

FIG. 38 is a graph illustrating a comparison of the average spray pattern diameters compared against percentage of product remaining in the container for the dispensing system of FIG. 1 and prior art dispensing systems. The data of graph 38 illustrates that the dispensing system 60 disclosed herein maintains a consistent average spray diameter throughout the life of the dispensing system 60, while prior art dispensers have spray patterns that reduce in diameter over time. To that end, another benefit of the dispensing system 60 disclosed herein is that it maintains a relatively constant spray diameter over the life of the dispensing system 60, which provides for a consistent user experience, and a user need not modify the amount of spray to achieve a desired fragrance coverage as the amount of product within the dispenser is reduced.

Thus, embodiments of the present disclosure provide an actuator assembly or nozzle insert for a product dispensing system. In some embodiments, the improved actuator assembly or nozzle insert can provide improved manufacturability and reduce defects arising during assembly (or use) from over-compression of a nozzle insert. For example, some embodiments of the invention provide a nozzle insert, and a corresponding nozzle-insert cavity in an actuator of an actuator assembly, with first and second stop portions that can mitigate the effects of over-compression of the nozzle insert. This can, for example, correspondingly reduce (e.g., eliminate) the probability of forming defects in the actuator assembly during assembly.

In alternative embodiments, the composition may include an insecticide disposed within a carrier liquid, a deodorizing liquid, or the like. The composition may also comprise other actives, such as sanitizers, mold or mildew inhibitors, insect repellents, and/or the like. In alternative embodiments, it is contemplated that the container 62 may contain any type of pressurized product and/or mixtures thereof; thus, the product dispensing system 60 may be adapted to dispense any number of different products. In some embodiments, the container 62 may contain liquefied, non-liquefied, or dissolved compressed gas, which may include one or more of the compressed gases listed above. In some embodiments, the container 62 may contain one or more of a hydrocarbon gas or hydrocarbon derivative, including acetylene, methane, propane, butane, isobutene, halogenated hydrocarbons, ethers, mixtures of butane and propane, otherwise known as liquid petroleum gas or LPG, and/or mixtures thereof.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol or non-aerosol container.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the disclosure. The exclusive rights to all modifications which come within the scope of the appended claims are reserved.

We claim:

1. A dispensing system containing a composition comprising one or more of a deodorizing composition, a fragrancing composition, or a cleaning composition, comprising:

a container having a body and defining a pressure therein, wherein the composition is disposed within the container, and wherein the pressure is at least 930 kPa; and an actuator assembly attached to the container, the actuator assembly comprising:

a housing, an actuator positioned within the housing and comprising a fluid passageway in fluid communication with the composition, and a nozzle insert disposed within the fluid passageway, and defining only a single nozzle orifice having an orifice diameter of between about 0.335 mm and about 0.385 mm, wherein the composition comprises a compressed gas and between about 5% and about 10% by volume ethanol, wherein the dispensing system is configured to spray the composition with a throw distance of between about 68.6 cm and 114 cm and a spray diameter of between about 127 mm and about 241 mm when the container is 100% to 25% full of the composition, and wherein the composition is configured to be sprayed from the dispensing system at a spray rate of between about 1.2 g/s and about 2.0 g/s when the container is 100% to 25% full of the composition.

2. The dispensing system of claim 1, wherein a valve stem of the container defines a longitudinal axis, and wherein a spray axis of the nozzle insert is between about 60° and about 70° offset from the longitudinal axis.

3. The dispensing system of claim 1, wherein the composition comprises between about 8% and about 10% by volume ethanol.

4. The dispensing system of claim 1, wherein the body has an outer wall that defines a thickness, and the thickness is greater than 0.50 mm.

5. The dispensing system of claim 1, wherein the pressure is at least 1050 kPa.

6. The dispensing system of claim 1, wherein the housing includes an outer wall, a top wall, and an inner wall extending downward from the top wall, and wherein an inner cavity is defined between the inner wall and the outer wall.

7. The dispensing system of claim 6, wherein the housing further includes a first retaining arm and a second retaining arm, and wherein each of the retaining arms depend downward from and are integral with the inner wall of the housing.

8. The dispensing system of claim 7, wherein each of the retaining arms include an inwardly-disposed catch, and wherein the catches of the first and second retaining arms are configured to prevent over actuation of the actuator.

9. The dispensing system of claim 6, wherein the actuator comprises a left arm and a right arm, and wherein the left arm and the right arm are each disposed within the inner cavity of the housing.

10. The dispensing system of claim 1, wherein the dispensing system has a percent fallout of between 25% and 30% from a spray height of between 122 cm and 152 cm.

11. The dispensing system of claim 1, wherein the insert comprises a central recess and a plurality of radially-extending channels that are disposed between four radially-disposed swirl features.

12. A dispensing system containing a composition comprising one or more of a deodorizing composition, a fragrancing composition, or a cleaning composition, comprising:

a container having a valve stem defining a longitudinal axis and a body defining a pressure therein, wherein the composition is disposed within the container, and wherein the pressure is at least 930 kPa; and an actuator assembly attached to the container, the actuator assembly comprising:

a housing, an actuator positioned within the housing and comprising a fluid passageway in fluid communication with the composition, and a nozzle insert disposed within the fluid passageway, and defining only a single nozzle orifice, the nozzle insert defining a spray axis that is between about 60° and about 70° offset from the longitudinal axis, wherein the composition comprises a compressed gas and between about 5% and about 10% by volume ethanol, wherein the dispensing system is configured to spray the composition with a throw distance of between about 68.6 cm and 114 cm and a spray diameter of between about 127 mm and about 241 mm when the container is 100% to 25% full of the composition, and wherein the composition is configured to be sprayed from the dispensing system at a spray rate of between about 1.2 g/s and about 2.0 g/s when the container is 100% to 25% full of the composition.

13. The dispensing system of claim 12, wherein a valve stem of the container defines a longitudinal axis, and wherein the nozzle insert defines a nozzle orifice having an orifice diameter of between about 0.335 mm and about 0.385 mm.

14. The dispensing system of claim 12, wherein the composition comprises between about 8% and about 10% by volume ethanol.

15. The dispensing system of claim 12, wherein the dispensing system has a percent fallout of between 25% and 30% from a spray height of between 122 cm and 152 cm.

16. The dispensing system of claim 12, wherein the pressure is at least 1050 kPa.

* * * * *